US009837017B2

(12) United States Patent
Park et al.

(10) Patent No.: US 9,837,017 B2
(45) Date of Patent: Dec. 5, 2017

(54) GATE DRIVER AND DISPLAY DEVICE HAVING THE SAME

(71) Applicant: Samsung Display Co., Ltd., Yongin-si, Gyeonggi-do (KR)

(72) Inventors: Su-Hyeong Park, Gyeongju-si (KR); Tae-Hyeong An, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/175,986

(22) Filed: Jun. 7, 2016

(65) Prior Publication Data

US 2017/0110050 A1 Apr. 20, 2017

(30) Foreign Application Priority Data

Oct. 16, 2015 (KR) ..... 10-2015-0144831

(51) Int. Cl.
*G09G 3/36* (2006.01)
*G09G 3/3208* (2016.01)

(52) U.S. Cl.
CPC ... *G09G 3/3208* (2013.01); *G09G 2300/0426* (2013.01)

(58) Field of Classification Search
CPC ..... G09G 2310/0286
USPC ..... 345/76–77, 100
See application file for complete search history.

(56) References Cited

U.S. PATENT DOCUMENTS

2006/0238482 A1* 10/2006 Jang ..... G09G 3/3677 345/100
2014/0098016 A1* 4/2014 Furuta ..... H03K 3/356104 345/100
2014/0140042 A1 5/2014 Schreiber
2015/0015840 A1 1/2015 Imanishi et al.
2015/0294619 A1* 10/2015 Lee ..... G09G 3/3266 345/77
2015/0358018 A1 12/2015 Kim et al.

FOREIGN PATENT DOCUMENTS

KR 10-2012-0019227 A 3/2012
KR 10-2015-0049121 A 5/2015
KR 10-2015-0142708 A 12/2015
KR 10-2016-0045215 A 4/2016
KR 10-2016-0095231 A 8/2016

* cited by examiner

*Primary Examiner* — Roy Rabindranath
(74) *Attorney, Agent, or Firm* — Lewis Roca Rothgerber Christie LLP

(57) ABSTRACT

A stage of a gate driver includes a carry generate block configured to output an (N)-th carry signal based on an input signal and to provide the (N)-th carry signal to an (N+1)-th stage; a first output block configured to output an (N)-th gate initialization signal based on the input signal, an input enable signal, and an input disable signal, wherein the input disable signal is inverted with respect to the input enable signal; and a second output block configured to receive the (N)-th gate initialization signal and to output an (N)-th gate signal according to the output of the (N)-th gate initialization signal; the (N)-th gate signal being delayed one horizontal period from the (N)-th gate initialization signal, wherein the gate signals and the gate initialization signals of the stages are selectively output based on the input enable signal and the input disable signal.

20 Claims, 15 Drawing Sheets

GATE DRIVER AND DISPLAY DEVICE HAVING THE SAME

CROSS REFERENCE TO RELATED APPLICATION

This application claims priority to and the benefit of Korean Patent Application No. 10-2015-0144831, filed on Oct. 16, 2015, in the Korean Intellectual Property Office (KIPO), the disclosure of which is hereby incorporated by reference herein in its entirety.

BACKGROUND

1. Field

Aspects of example embodiments of the present invention relate to display devices.

2. Discussion of Related Art

A display device may include a display panel and a display panel driver. The display panel may include a plurality of gate lines, a plurality of data lines, and a plurality of pixels. The display panel driver may include a gate driver and a data driver. The gate driver may include a plurality of stages configured to sequentially or concurrently output gate signals, gate initialization signals, and organic light emitting diode initialization signals.

Driving methods for partially (or selectively) providing gate signals to the gate lines to perform a low-power driving or a partial driving of the display panel have recently been a focus of research and development. For example, the stages may be divided into multiple block groups and a plurality of frame start indication signals may be applied each of the block groups. Outputs of the gate signals (or the gate lines) may be controlled based on a block-by-block (or group-by-group) control by controlling output timing of the frame start indication signals. However, this method may not be capable of controlling on/off operations of the gate signal by a line-by-line control. In addition, for controlling by line-by-line in this method, a plurality of frame start indication signals (or gate control signals) corresponding to the number of the gate lines may be provided.

It is to be understood that this Background section is intended to provide useful background for understanding the technology and as such, the Background section of the present disclosure may include ideas, concepts, or information that does not constitute prior art.

SUMMARY

Aspects of example embodiments of the present invention relate to display devices. For example, some example embodiments of the present invention relate to gate drivers driving gate lines of a display panel and display devices having the gate drivers.

Example embodiments of the present invention may include a gate driver configured to selectively output gate signals and gate initialization signals.

Example embodiments of, the present invention may include a display device including the gate driver.

According to some example embodiments of the present invention, a gate driver includes a plurality of stages configured to respectively output a plurality of gate signals and a plurality of gate initialization signals, an (N)-th stage from among the plurality of stages including: a carry generate block configured to output an (N)-th carry signal based on an input signal and to provide the (N)-th carry signal to an (N+1)-th stage; a first output block configured to output an (N)-th gate initialization signal based on the input signal, an input enable signal, and an input disable signal, wherein the input disable signal is inverted with respect to the input enable signal; and a second output block configured to receive the (N)-th gate initialization signal and to output an (N)-th gate signal according to the output of the (N)-th gate initialization signal, the (N)-th gate signal being delayed one horizontal period from the (N)-th gate initialization signal, wherein the gate signals and the gate initialization signals of the stages are selectively output based on the input enable signal and the input disable signal, and wherein N is a positive integer.

According to some embodiments, the first output block includes: a first node controller configured to transmit an input node signal, which is a signal at an input node, or a first direct current (DC) voltage to a first node as a first node signal based on a first clock signal and a second clock signal; a second node controller configured to transmit a second DC voltage less than the first DC voltage or the first clock signal to a second node as a second node signal based on the first node signal; a first output buffer configured to output the (N)-th gate initialization signal based on the first node signal and the second node signal; and an input controller configured to control the input node signal based on the input enable signal and the input disable signal.

According to some embodiments, the input signal is provided to the input node as the input node signal when the input enable signal has a low level, and the first DC voltage is provided to the input node as the input node signal when the input enable signal has a high level.

According to some embodiments, the input controller includes: a first control switch comprising a gate electrode to which the input enable signal is applied, a source electrode to which the input signal is applied, and a drain electrode connected to the input node; and a second control switch comprising a gate electrode to which the input disable signal is applied, a source electrode to which the first DC voltage is applied, and a drain electrode connected to the input node.

According to some embodiments, the first node controller includes: a first switch comprising a gate electrode configured to receive the first clock signal, a source connected to the input node, and a drain electrode connected to the first node; a second switch comprising a gate electrode configured to receive the second node signal, a source electrode to which the first DC signal is applied, and a drain electrode configured to provide the first DC voltage to the first node; and a third switch comprising a gate electrode configured to receive the second clock signal, a source electrode connected to the drain electrode of the second switch, and a drain electrode connected to the first node.

According to some embodiments, the first node controller includes: a first switch comprising a gate electrode configured to receive the first clock signal, a source electrode connected to an input terminal configured to receive the input signal, and a drain electrode connected to the source electrode of the first control switch; a second switch comprising a gate electrode configured to receive the second node signal, a source electrode configured to receive the first DC signal, and a drain electrode configured to provide the first DC voltage to the first node; and a third switch comprising a gate electrode configured to receive the second clock signal, a source electrode connected to the drain electrode of the second switch, and a drain electrode connected to the first node.

According to some embodiments, the second node controller includes: a fourth switch comprising a gate electrode configured to receive the first node signal, a source electrode configured to receive the first clock signal, and a drain electrode connected to the second node; and a fifth switch comprising a gate electrode configured to receive the first clock signal, a source electrode configured to receive the second DC voltage, and a drain electrode connected to the second node.

According to some embodiments, the first output buffer includes: a pull-up switch comprising a gate electrode connected to the second node, a source electrode configured to receive a pull-up voltage, and a drain electrode connected to an output terminal configured to output the (N)-th gate initialization signal; and a pull-down switch comprising a gate electrode connected to the first node, a source electrode connected to the output terminal, and a drain electrode configured to receive the second clock signal.

According to some embodiments, the carry generate block includes: a third node controller configured to transmit the input signal or the first DC voltage to a third node as a third node signal based on the first clock signal and the second clock signal; a fourth node controller configured to transmit the second DC voltage or the first clock signal to a fourth node as a fourth node signal based on the first clock signal and the third node signal; and a second output buffer configured to output the (N)-th carry signal based on the third node signal and the fourth node signal.

According to some embodiments, the second output block includes: a fifth node controller configured to transmit the (N)-th gate initialization signal or the first DC voltage to a fifth node as a fifth node signal based on the first clock signal and the second clock signal; a sixth node controller configured to transmit the second DC voltage or the second clock signal to a sixth node as a sixth node signal based on the second clock signal and the fifth node signal; and a third output buffer configured to output the (N)-th gate signal based on the fifth node signal and the sixth node signal.

According to some embodiments, the input signal is a frame start indication signal or a carry signal of a previous stage.

According to some embodiments, the (N)-th stage is configured to skip output of the (N)-th gate initialization signal and the (N)-th gate signal when the (N)-th stage receives the input signal having a low level and the input enable signal having a high level.

According to some example embodiments of the present invention, a gate driver includes a plurality of stages configured to respectively output a plurality of gate signals and a plurality of gate initialization signals, an (N)-th stage from among the plurality of stages including: a carry generate block configured to output an (N)-th carry signal based on an input signal and to provide the (N)-th carry signal to an (N+1)-th stage; a first output block configured to output an (N)-th gate initialization signal based on the input signal and an output disable signal; and a second output block configured to receive the (N)-th gate initialization signal and to output an (N)-th gate signal according to the output of the (N)-th gate initialization signal, the (N)-th gate signal being delayed one horizontal period from the (N)-th gate initialization signal, wherein the gate signals and the gate initialization signals of the stages are selectively output based on the output disable signal, and wherein N is a positive integer.

According to some embodiments, the first output block includes: a first node controller configured to transmit the input signal or a first direct current (DC) voltage to a first node as a first node signal based on a first clock signal and a second clock signal; a second node controller configured to transmit a second DC voltage less than the first DC voltage or the first clock signal to a second node as a second node signal based on the first clock signal and the first node signal; an output buffer configured to output the (N)-th gate initialization signal based on the first node signal and the second node signal; and an output controller configured to initialize the first node signal and the second node signal based on the output disable signal.

According to some embodiments, the output controller is configured to apply the first DC voltage to the first node and to apply the second DC voltage to the second node, when the output disable signal has a low level.

According to some embodiments, the output controller includes: a first control switch comprising a gate electrode configured to receive the output disable signal, a source electrode configured to receive the first DC voltage, and a drain electrode connected to the first node; and a second control switch comprising a gate electrode configured to receive the output disable signal, a source electrode configured to receive the second DC voltage, and a drain electrode connected to the second node.

According to some embodiments, the (N)-th stage is configured to skip output of the (N)-th gate initialization signal and the (N)-th gate signal when the (N)-th stage receives the first clock signal having a high level, the second clock signal having the high level, and the output disable signal having a low level.

According to some embodiments, the output controller further includes: a third control switch configured to disconnect the first node controller from the first node based on an output enable signal, wherein the output enable signal is inverted with respect to the output disable signal; and a fourth control switch configured to disconnect the second node controller from the second node based on the output enable signal.

According to some example embodiments of the present invention, a display device includes: a display panel including a plurality of pixels; a data driver configured to output a plurality of data signals to the display panel via a plurality of data lines; and a gate driver comprising a plurality of stages configured to respectively output a plurality of gate signals and a plurality of gate initialization signals to the display panel, wherein an (N)-th stage of the gate driver includes: a carry generate block configured to output an (N)-th carry signal based on an input signal and to provide the (N)-th carry signal to an (N+1)-th stage; a first output block configured to output an (N)-th gate initialization signal based on the input signal, an input enable signal, and an input disable signal, wherein the input disable signal is inverted with respect to the input enable signal; and a second output block configured to receive the (N)-th gate initialization signal and to output an (N)-th gate signal according to the output of the (N)-th gate initialization signal, the (N)-th gate signal being delayed one horizontal period from the (N)-th gate initialization signal, wherein the gate signals and the gate initialization signals of the stages are selectively output based on the input enable signal and the input disable signal, and wherein N is a positive integer.

According to some embodiments, the (N)-th stage is configured to skip output of the (N)-th gate initialization signal and the (N)-th gate signal when the (N)-th stage receives the input signal having a low level and the input enable signal having a high level.

Therefore, a gate driver according to some example embodiments of the present invention may include the carry generate block for independently generating the carry signal, the first output block for selectively outputting (or skipping) the gate initialization signal based on the input disable signal or the output disable signal, and the second output block for selectively outputting the gate signal depending on the output of the gate initialization signal. Thus, specific gate initialization signals and gate signals in one frame may be selectively skipped (or updated). That is, the gate driver may skip providing gate signals to specific gate lines (and gate initialization lines) corresponding to pixel rows required not to update image. Thus, it may be possible to control to the gate signals (and the gate initialization signals) line-by-line.

In addition, it may be relatively easy to perform a partial driving and a partial displaying of the display panel, and an output swing frequency of the data driver according to an image change (or image update) may be reduced, and thus power consumption of the display device may be reduced.

BRIEF DESCRIPTION OF THE DRAWINGS

Example embodiments can be understood in more detail from the following description taken in conjunction with the accompanying drawings, in which.

DETAILED DESCRIPTION OF EMBODIMENTS

Figure 1:
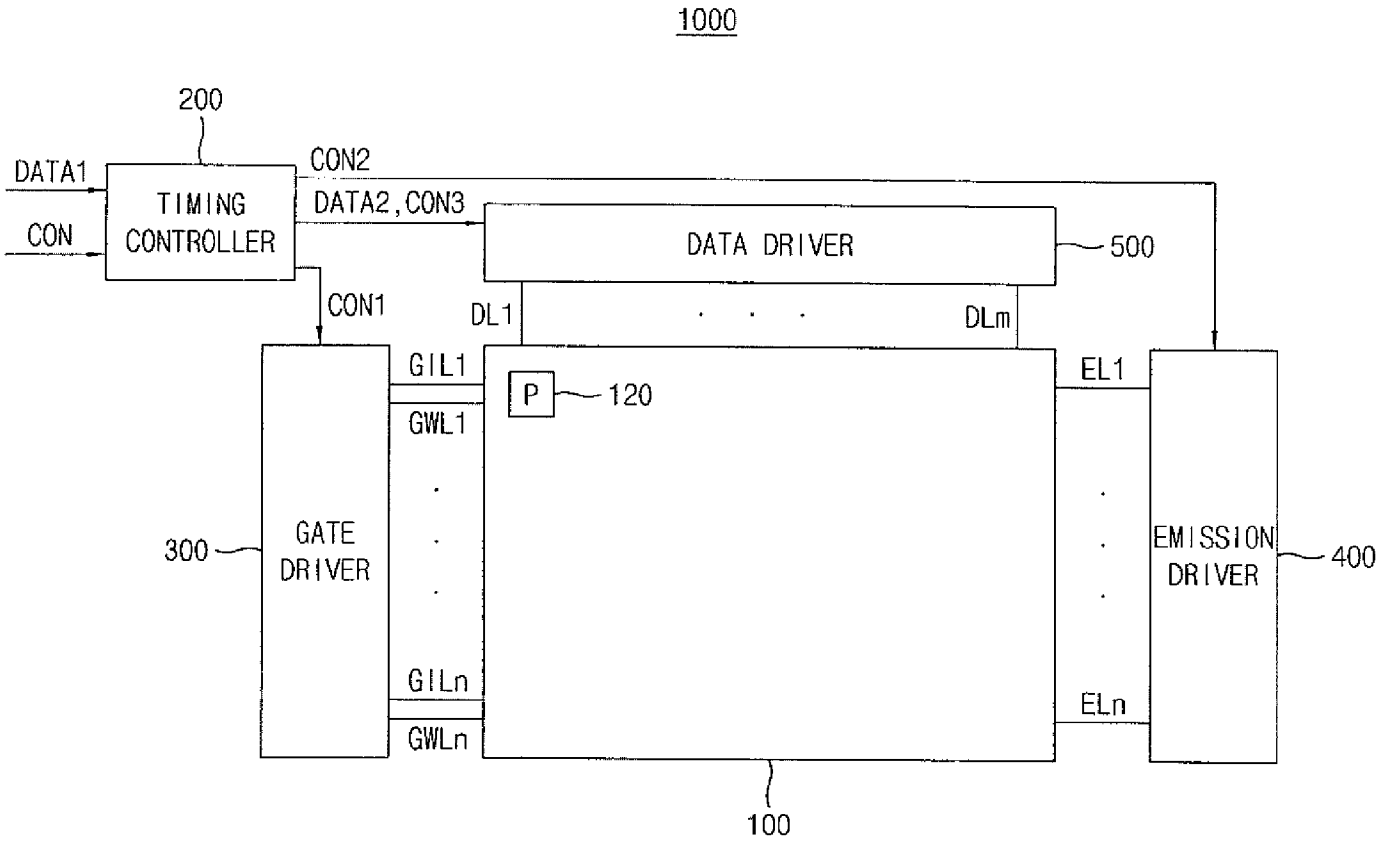
FIG. 1 is a block diagram of a display device according to some example embodiments of the present invention.

Aspects of example embodiments of the present invention will be described more fully hereinafter with reference to the accompanying drawings, in which various embodiments are shown.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of,"

when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram of a display device according to some example embodiments of the present invention.

Referring to FIG. 1, the display device 1000 may include a display panel 100, a timing controller 200, a gate driver 300, and a data driver 500. The display device 1000 may further include an emission driver 400.

For example, the display device 1000 may be an organic light emitting display device.

The display panel 100 may display an image. The display panel 100 may include a plurality of gate lines GWL1 to GWLn, a plurality of gate initialization lines GIL1 to GILn, a plurality of emission control lines EL1 to ELn, a plurality of data lines DL1 to DLm, and a plurality of pixels 120 connected to the gate lines GWL1 to GWLn, the gate initialization lines GIL1 to GILn, the emission control lines EL1 to ELn, and the data lines DL1 to DLm. For example, the pixels 120 may be arranged in a matrix arrangement. In some embodiments, the number of the gate lines GWL1 to GWLn may be n, and the number of the data lines DL1 to DLm may be m, where n and m are positive integers. In some embodiments, the number of pixels 120 may be n×m. In some embodiments, the display panel 100 may further include a plurality of organic light emitting diode initialization lines to initialize anodes of the organic light emitting diodes each included in the pixel 120.

The timing controller 200 may control the gate driver 300, the emission driver 400, and the data driver 500. The timing controller 200 may receive an input control signal CON and an input image signal DATA1 from an image source such as an external graphic apparatus.

The timing controller 200 may generate a data signal DATA2, which may be a digital signal and corresponds to operating conditions of the display panel 100 based on the input image signal DATA1. In addition, the timing controller 200 may generate a first control signal CON1 for controlling a driving timing of the gate driver 300, a second control signal CON2 for controlling a driving timing of the emission driver 400, and a third control signal CON3 for controlling the data driver 500 based on the input control signal CON. The timing controller 200 may output the first to third control signals CON1, CON2, and CON3 to the gate driver 300, the emission driver 400, and the data driver 500, respectively. In some embodiments, the timing controller 200 may control an input enable signal and an input disable signal that are applied to the gate driver 300.

The gate driver 300 may output a plurality of gate signals to the display panel 100 via the gate lines GWL1 to GWLn and output a plurality of gate initialization signals to the display panel 100 via the gate initialization lines GIL1 to GILn, respectively. The gate driver 300 may output the gate signals and the gate initialization signals based on the first control signal CON1 received from the timing controller 200. The gate driver 300 may include a plurality of stages each outputting one of the gate signals and one of the gate initialization signals. In some embodiments, the gate driver 300 may receive a first clock signal, a second clock signal, a frame start indication signal, the input enable signal, and the input disable signal.

The gate driver 300 may selectively output (or skip) the gate initialization signals and the gate signals based on the input enable signal and the input disable signal. Thus, only pixels rows connected to selected gate initialization lines and selected gate lines may receive the gate initialization signal and the gate signal. In some embodiments, the gate driver 300 embedded in the display panel 100 may include a plurality of P-channel metal oxide semiconductor (PMOS) transistors.

An (N)-th stage included in the gate driver 300 may include a carry generate block, a first output block, and a second output block, where N is a positive integer.

The carry generate block may output an (N)-th carry signal based on an input signal and to provide the (N)-th carry signal to an (N+1)-th stage. The input signal may be a frame start indication signal or a carry signal (e.g., an (N−1)-th carry signal) output from a previous stage (e.g., an (N−1)-th stage). The first output block may output an (N)-th gate initialization signal based on the input signal, the input enable signal, and the input disable signal, which is a signal inverted from the input enable signal. The second output block may receive the (N)-th gate initialization signal and output an (N)-th gate signal according to the (N)-th gate initialization signal. The (N)-th gate signal may be delayed one horizontal period from the (N)-th gate initialization signal.

The emission driver 400 may output a plurality of emission control signals to the display panel 100 via the emission control lines EL1 to ELn. The emission driver 400 may sequentially output the emission control signals to the respective emission control lines EL1 to ELn at each frame based on the second control signal CON2 received from the timing controller 200.

The data driver 500 may convert the data signal DATA2 received from the timing controller 200 into a data voltage of an analog type based on the third control signal CONS received from the timing controller 200. The data driver 500 may output the data voltage to the data lines DL1 to DLm.

In some embodiments, the display device 1000 may further include a driver for providing organic light emitting diode initialization signals to the organic light emitting diode initialization lines.

Accordingly, the display device 1000 may include the gate driver 300 that selectively outputs the gate initialization signals and the gate signals based on the input enable/disable signals, such that the image may be selectively updated according to selected pixels rows. Thus, an output swing frequency of the data driver 500 according to an image change (or image update) may be reduced, and thus power consumption by the operations of the drivers may be reduced.

Figure 2:
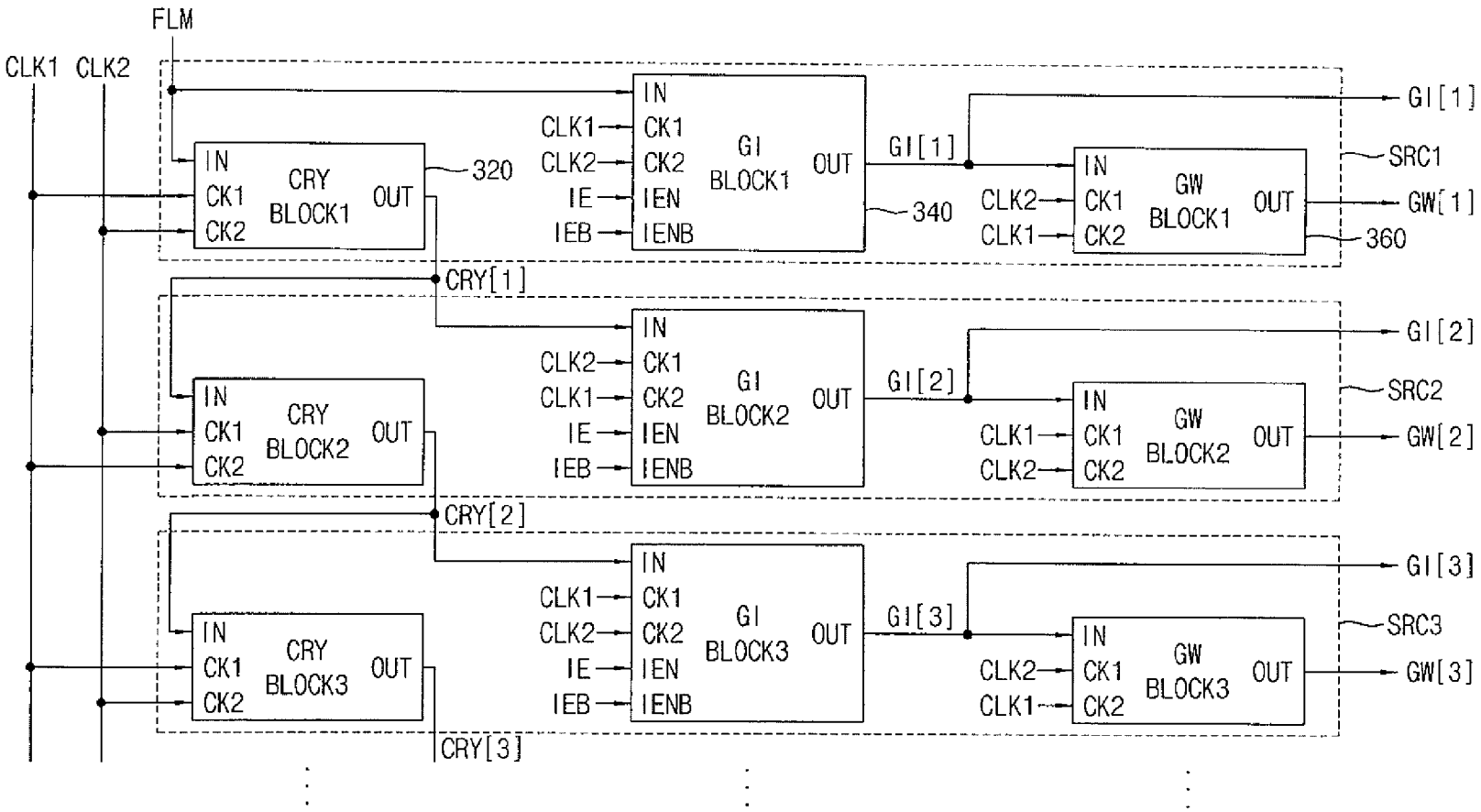
FIG. 2 is a block diagram of a gate driver according to some example embodiments of the present invention.

FIG. 2 is a block diagram of a gate driver according to example embodiments.

Referring to FIGS. 1 and 2, the gate driver 300 may include a plurality of stages SRC1, SRC2, SRC3, etc., connected to one another. The number of stages is not limited to 3 stages, but rather the gate driver 300 may include any suitable number of stages according to the design of the gate driver 300.

Each of the stages SRC1, SRC2, SRC3, etc., may include a carry generate block 320, a first output block 340, and a second output block 360. Each of the carry output blocks 320, the first output blocks 340, and the second output blocks 360 may include an input terminal IN, a first clock terminal CK1, a second clock terminal CK2, and an output terminal OUT. The first output block 340 may further include an enable terminal IEN and a disable terminal IENB. The carry generate block 320, the first output block 340, and the second output block 360 may further include terminals each receiving a first direct current (DC) voltage and a second DC voltage less than the first DC voltage.

A first clock signal CLK1 and a second clock signal CLK2 may be provided to the carry generate block 320, the first output block 340, and the second output block 360. The first and second clock signals CLK1 and CLK2 may have substantially the same period, and the second clock signal CLK2 can be obtained by shifting the first clock signal CLK1 by half of the period of the first clock signal CLK1. The half of the period of the first clock signal CLK1 may correspond to one horizontal period. In adjacent stages, the first and second clock signals CLK1 and CLK2 may be applied in opposite sequences.

For example, the first and second clock signals CLK1 and CLK2 may be applied to the first and second clock terminals CK1 and CK2 of the carry generate block 320 and the first output block 340, respectively, of odd-numbered stages SRC1, SRC3, . . . . In contrast, the second and first clock signals CLK2 and CLK1 may be applied to the first and second clock terminals CK1 and CK2 of the carry generate block 320 and the first output block 340, respectively, of even-numbered stages SRC2, . . . . In addition, the second and first clock signals CLK2 and CLK1 may be applied to the first and second clock terminals CK1 and CK2 of the second output block 360, respectively, of the odd-numbered stages SRC1, SRC3, . . . . The first and second clock signals CLK1 and CLK2 may be applied to the first and second clock terminals CK1 and CK2 of the second output block 360, respectively, of the even-numbered stages SRC2, . . . .

The carry generate block 320 may output the carry signal CRY[1] based on the input signal FLM. The frame start indication signal FLM or the carry signals of the previous stage may be applied to the input terminal IN of the carry generate block 320. The frame start indication signal FLM may be applied to the input terminal IN of the carry generate block 320 of a first stage SRC1, and the carry signals of the previous stages may be applied to the respective input terminals IN of the other carry generate blocks of the stages SRC2, SRC3, . . . .

The output terminals OUT of the carry generate block 320 may output the carry signal CRY[1] to the input terminal IN of the carry generate block of next stage (e.g., a second stage SRC2) and the input terminal IN of the first output block of the next stage (e.g., the second stage SRC2). For example, the carry signals CRY[1], CRY[3], output from the odd-numbered stages SRC1, SRC3, . . . may be output when the second clock signal CLK2 has a low level. For example, the carry signals CRY[2], . . . output from the even-numbered stages SRC2, . . . may be output when the first clock signal CLK1 has the low level.

The first output block 340 may output the gate initialization signal GI[1] based on the input signal FLM, the input enable signal IE, and the input disable signal IEB. The input disable signal IEB may be a signal inverted from the input enable signal IE. The input enable signal IE and the input disable signal IEB may be applied to the all stages SRC1, SRC2, SRC3, . . . in common.

The frame start indication signal FLM or the carry signal of the previous stage may be applied to the input terminal IN of the first output block 340. That is, the frame start indication signal FLM may be applied to the input terminal IN of the first output block 340 of the first stage SRC1, and the carry signals of the previous stages may be applied to the respective input terminals IN of the other first output blocks of the stages SRC2, SRC3, . . . . The output terminal OUT of the first output block 340 may transmit the gate initialization signal GI[1] to the second output block 360 of the same stage and the corresponding gate initialization line. The gate initialization signals GI[1], GI[3], . . . output from the odd-numbered stages SRC1, SRC3, . . . may be output when the second clock signal CLK2 has the low level. For example, the gate initialization signals GI[2], . . . output from the even-numbered stages SRC2, . . . may be output when the first clock signal CLK1 has the low level. Here, the first output block 340 may not output the gate initialization signal when the input enable signal IE has a high level.

The second output block 360 may receive the gate initialization signal GI[1] and output the gate signal GW[1] according to the gate initialization signal GI[1]. The gate signal GW[1] may be delayed one horizontal period form the gate initialization signal GI[1]. The gate initialization signal GI[1] may be input to the input terminal IN of the second output block 360.

The output terminal OUT of the second output block 360 may output the gate signal GW[1]. For example, the gate signals GW[1], GW[3], . . . output from the odd-numbered stages SRC1, SRC3, . . . may be output when the first clock signal CLK1 has the low level. For example, the gate signals GW[2], . . . output from the even-numbered stages SRC2, . . . may be output when the second clock signal CLK2 has the low level. Thus, the gate signals GW[1], GW[2], GW[3], . . . may be delayed with respect to the respective gate initialization signals GI[1], GI[2], GI[3], . . . and the delayed period may correspond to the one horizontal period. The second output block 360 may output the gate signal GW[1] according to the output of the gate initialization signal GI[1], so that the second output block 360 may cannot output the gate signal GW[1] without the output of the gate initialization signal GI[1].

Figure 3:
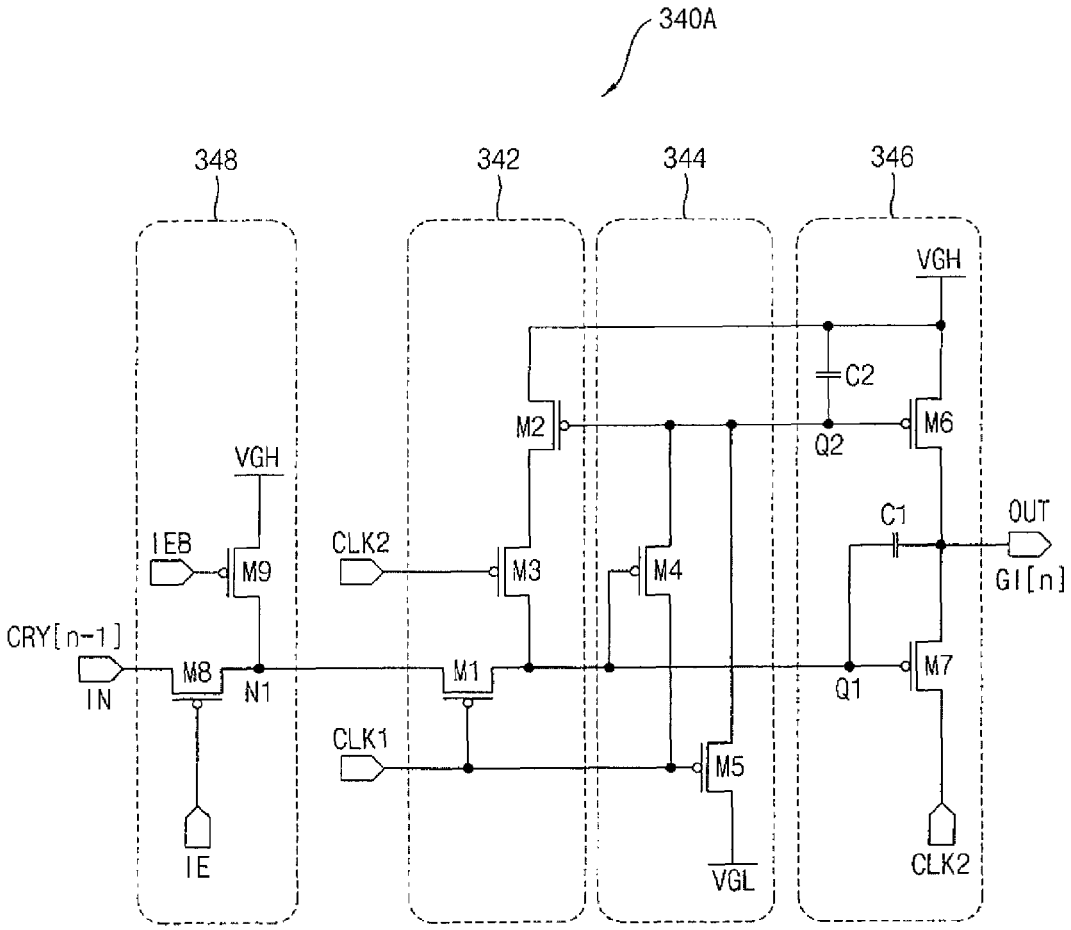
FIG. 3 is a circuit diagram illustrating an example of a first output block included in an (N)-th stage of the gate driver of FIG. 2.
Figure 4:
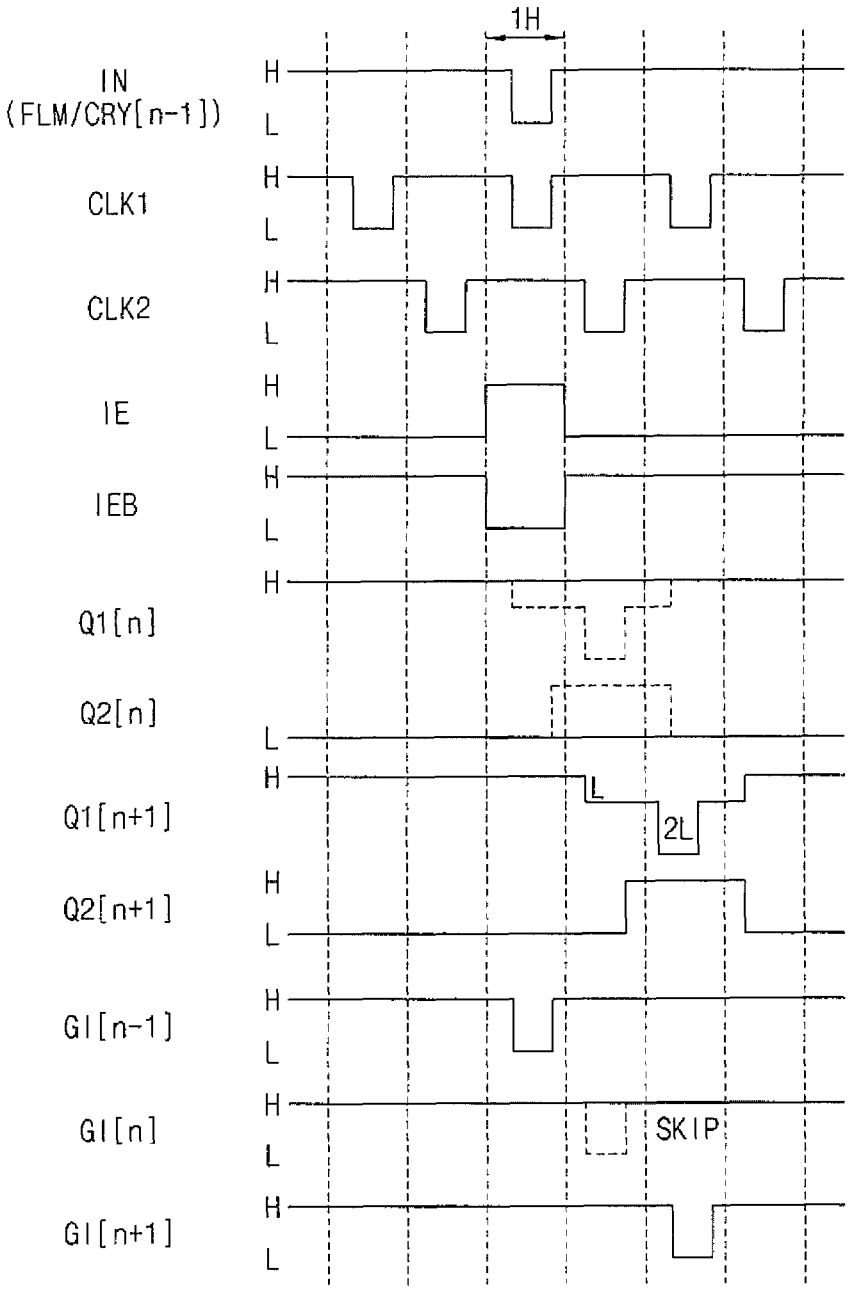
FIG. 4 is a timing diagram for explaining operations of the first output block of FIG. 3.

FIG. 3 is a circuit diagram illustrating an example of a first output block included in an (N)-th stage of the gate driver of FIG. 2. FIG. 4 is a timing diagram for explaining operations of the first output block of FIG. 3.

Referring to FIGS. 2 to 4, the first output block 340A included in the (N)-th stage may include a first node control part (or first node controller) 342, a second node control part (or second node controller) 344, a first output buffer part (or first output buffer) 346, and an input control part (or input controller) 348.

Hereinafter, example embodiments will be explained with the gate driver 300 and the display device 1000 that are include PMOS transistors. Thus, switches M1 to M10 may be turned on when a signal having a low level is applied to each gate electrode of the switches. Because these are examples, the gate driver may include NMOS transistors.

The first node control part 342 may transmit an input node signal (e.g., FLM or CRY[n−1]), which is a signal at an input node N1, or a first direct current (DC) voltage VGH to a first node Q1 as a first node signal Q1[*n*] based on a first clock signal CLK1 and a second clock signal CLK2. The first node control part 342 may include a first switch M1, a second switch M2, and a third switch M3.

The first switch M1 may include a gate electrode to which the first clock signal CLK1 is applied, a source connected to the input node N1, and a drain electrode connected to the first node Q1. The second switch M2 may include a gate electrode to which the second node signal Q2[*n*], which is a signal a the second node Q2, is applied, a source electrode to which the first DC voltage VGH is applied, and a drain electrode configured to provide the first DC voltage VGH to the first node Q1. The third switch M3 may include a gate electrode to which the second clock signal CLK2 is applied, a source electrode connected to the drain electrode of the second switch M2, and a drain electrode connected to the first node Q1. Here, the second and third switches M2 and M3 may be connected in series each other.

The second node control part 344 may transmit a second DC voltage VGL less than the first DC voltage VGH or the first clock signal CLK1 to the second node Q2 as a second node signal Q2[*n*] based on the first node signal Q1[*n*]. The second node control part 344 may include a fourth switch M4 and a fifth switch M5.

The fourth switch M4 may include a gate electrode to which the first node signal Q1[*n*] is applied, a source electrode to which the first clock signal CLK1 is applied, and a drain electrode connected to the second node Q2. The fifth switch M5 may include a gate electrode to which the first clock signal CLK1 is applied, a source electrode to which the second DC voltage VGL is applied, and a drain electrode connected to the second node Q2.

The first output buffer part 346 may output the (N)-th gate initialization signal GI[n] based on the first node signal Q1[*n*] and the second node signal Q2[*n*]. The first output buffer part 346 may include a pull-up switch M6 and a pull-down switch M7.

The pull-up switch M6 may include a gate electrode connected to the second node Q2, a source electrode to which a pull-up voltage is applied, and a drain electrode connected to an output terminal OUT for outputting the (N)-th gate initialization signal GI[n].

The pull-down switch M7 may include a gate electrode connected to the first node Q1, a source electrode connected to the output terminal OUT, and a drain electrode to which the second clock signal CLK2 is applied. The first output buffer part 346 may further include a capacitor C2 having a first end connected to the source electrode of the pull-up switch M6 and a second end connected to the gate electrode of the pull-up switch M6.

The first output buffer part 346 may further include a capacitor C1 having a first end connected to the source electrode of the pull-down switch M7 and a second end connected to the gate electrode of the pull-down switch M7. As illustrated in FIG. 4, in the first output block of the (N+1)-th stage, when the first clock signal CLK1 changes to the low level L, the first node Q1 may be bootstrapped by the capacitor C1 of the first output buffer part 346 so that the first node signal Q1[*n*+1] may have a second low level 2L and an (N+1)-th gate initialization signal GI[n+1] having the low level L may be output to the output terminal OUT.

The input control part 348 may control the input node signal CRY[n−1] based on the input enable signal IE and the input disable signal IEB. The input control part 348 may include a first control switch M8 and a second control switch M9. The first control switch M8 may include a gate electrode to which the input enable signal IE is applied, a source electrode to which the input signal CRY[n−1] is applied, and a drain electrode connected to the input node N1. The second control switch M9 may include a gate electrode to which the input disable signal IEB is applied, a source electrode to which the first DC voltage VGH is applied, and a drain electrode connected to the input node N1.

In some embodiments, the input signal CRY[n−1] may be applied to the input node N1 when the input enable signal IE has a low level L and the input disable signal IEB has a high level H. Thus, when the input enable signal has the high level H and the input disable signal has the low level L, the first node signal may maintain the high level regardless of a level of the input signal CRY[n−1], and thus the gate initialization signal GI[n] may be not output (or the gate initialization signal GI[n] may maintain the high level H).

Hereinafter, operations of the first output block 340A of the (N)-th stage when the input enable signal IE has the high level H will be explained with reference to FIGS. 3 and 4.

In some embodiments, the first output blocks included in the respective stages may sequentially output the gate initialization signals. The first output block 340A may skip the output of the gate initialization signal GI[n] based on the input enable signal IE.

The first clock signal CLK1 and the second clock signal CLK2 may have substantially the same period, and the second clock signal CLK2 can be obtained by shifting the first clock signal CLK1 by half of the period of the first clock signal CLK1. The half of the period of the first clock signal CLK1 may correspond to one horizontal period 1H.

The input enable signal IE may have the high level H and the input disable signal IEB may have the low level L, when the input signal CRY[n−1] and the first clock signal CLK1 have the low level L. The input disable signal IEB may be a signal inverted from the input enable signal IE. Thus, the first control switch M8 may be turned off and the second control switch may be turned on. Here, the first, second, fifth switches M1, M2, and M5 may be turned on and the third and fourth switches M3 and M4 may be turned off. Thus, the first node signal Q1[*n*] may have the high level H due to the input control part 348 (e.g., the first and second control switches M8 and M9), and the second node signal Q2[*n*] may have the low level L due to the second node control part 344 (e.g., the fourth and fifth switches M4 and M9).

Then, although the second clock signal CLK2 becomes the low level L, the first node signal Q1[*n*] may maintain the high level H and the second node signal Q2[*n*] may maintain the low level L. Thus, the gate initialization signal GI[n] may not be changed to the low level L.

Accordingly, when the input enable signal IE of the high level H and the input disable signal IEB of the low level L are applied to the input control part 348, the first output block 340A may skip the output of the gate initialization signal GI[n] regardless of the input the input signal CRY [n−1].

However, in the next stage (e.g., the (N+1)-th stage), the input enable signal IE has the low level L and the input disable signal IEB has the high level H when the input signal (e.g., CRY[n]) having the low level is input. Thus, the (N+1)-th gate initialization signal GI[n+1] may be normally output. In this, the first output block 340A may be driven by substantially the same operation of the carry generate block (and the second output block). In addition, the first output block of the (N+1)-th stage may output the gate initialization signal GI[n+1] at the same timing as the carry signal CRY[n+1].

In other words, the first output block 340A may sequentially output the gate initialization signal (e.g., the low level of the gate initialization signal) when the input enable signal IE of the low level l and the input disable signal IEB of the high level are applied to the gate driver 300.

Figure 5:
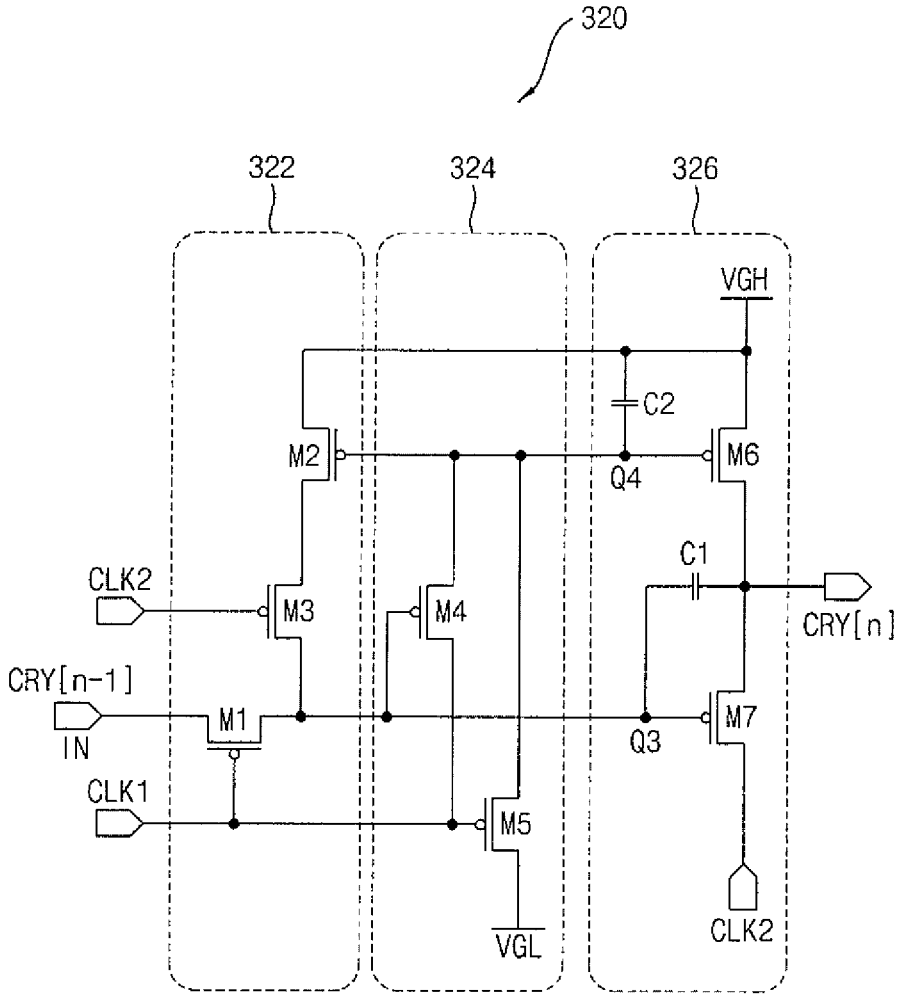
FIG. 5 is a circuit diagram illustrating an example of a carry generate block included in an (N)-th stage of the gate driver of FIG. 2.
Figure 6:
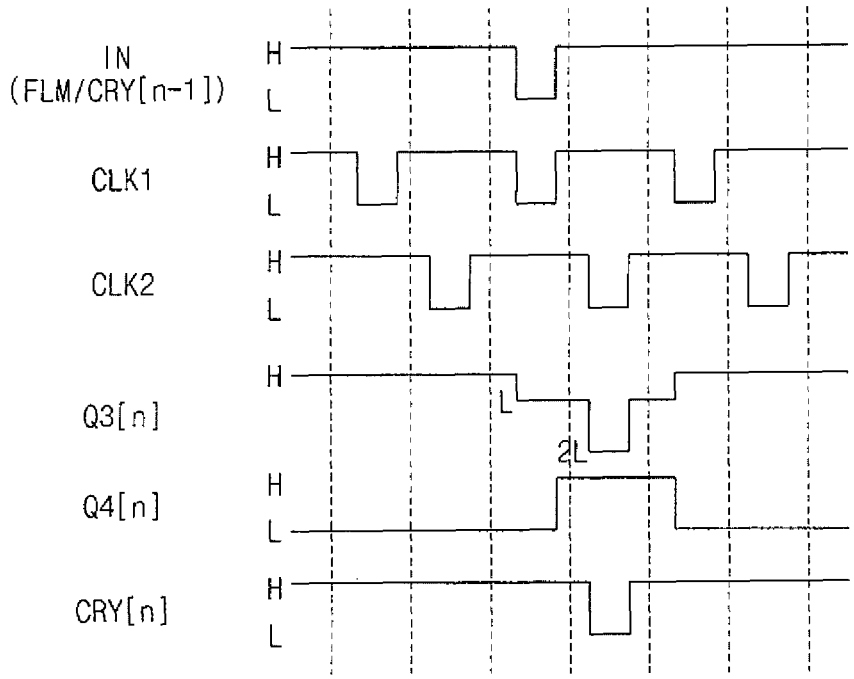
FIG. 6 is a timing diagram for explaining operations of the carry generate block of FIG. 5.

FIG. 5 is a circuit diagram illustrating an example of a carry generating block included in an (N)-th stage of the gate driver of FIG. 2. FIG. 6 is a timing diagram for explaining operations of the carry generating block of FIG. 5.

The carry generate block of the present example embodiments are substantially the same as the first output block explained with reference to FIGS. 2 to 4 except for constructions of the input control part of the first output block. Thus, the same reference numerals will be used to refer to the same or like parts as those described in the example embodiments of FIGS. 1 to 6, and some repetitive explanation concerning the above elements will be omitted.

Referring to FIGS. 2 to 6, the carry generate block 320 included in the (N)-th stage may include a third node control part 322, a fourth node control part 324, and a second output buffer part 326.

The carry generate block 320 may output an (N)-th carry signal CRY[n] based on an input signal CRY[n−1]. The (N)-th carry signal CRY[n] may be concurrently provided to an input terminal of a first output block of an (N+1)-th stage and an input terminal of a first output block of the (N+1)-th stage. In some embodiments, the input signal CRY[n−1] may be a frame start indication signal FLM when the (N)-th stage is the first stage.

The third node control part 322 may transmit the input signal CRY[n−1] or the first DC voltage VGH to a third node Q3 as a third node signal Q3[*n*] based on the first clock signal CLK1 and the second clock signal CLK2. The third node control part 322 may include a first switch M1, a second switch M2, and a third switch M3. The constructions and operations of the third node control part 322 may be substantially the same as the first node control part 342 of the first output block 340A.

The fourth control part 324 may transmit the second DC voltage VGL or the first clock signal CLK1 to a fourth node Q4 as a fourth node signal Q4[*n*] based on the first clock signal CLK1 and the third node signal Q3[*n*]. The fourth control part 324 may include a fourth switch M4 and a fifth switch M5. The constructions and operations of the fourth node control part 324 may be substantially the same as the second node control part 342 of the first output block 340A.

The second output buffer part 326 may output the (N)-th carry signal CRY[n] based on the third node signal Q3 and the fourth node signal Q4. The second output buffer part 326 may include a pull-up switch M6 and a pull-down switch M7. The second output buffer part 326 may further include capacitors C1 and C2 connected to respective the pull-up switch M6 and the pull-down switch M7. As illustrated in FIG. 6, when the second clock signal CLK2 changes to the low level L, the third node Q3 may be bootstrapped by the capacitor C1 so that the third node signal Q3[*n*] may have a second low level 2L and an (N)-th carry signal CRY[n] having the low level L may be output.

As illustrated in FIG. 6, the input signal CRY[n−1] applied to the input terminal IN and the first clock signal CLK1 may concurrently become the low level L. Here, the third node signal Q3[*n*] may have a first low level L due to the third node control part 322 and the fourth node signal Q4[*n*] may have the low level L due to the fourth node control part 324. That is, the first, second, fourth, and fifth switches M1, M2, M4, and M5 may be turned on by the input signal CRY[n−1] and the first clock signal CLK1, and the third switch M3 may be turned off by the second clock signal CLK2.

Then, the first clock signal CLK1 may be changed to the high level H such that the first and the fifth switches M1 and M2 may be turned off and the fourth node signal Q4[*n*] may be changed to the high level H by the fourth node control part 324 (e.g., the fourth switch M4 transmit the high level signal to the fourth node Q4.).

When the second clock signal CLK2 changes the low level L, the third node Q3 may be bootstrapped by the capacitor C1 so that the third node signal Q3[*n*] may have a second low level 2L and an (N)-th carry signal CRY[n] having the low level L may be output.

Then, when the second clock signal CLK2 turns back to the high level H, the third node signal Q3[*n*] may increase to the low level L and the (N)-th carry signal CRY[n] may change to the high level H.

Then, when the first clock signal CLK1 turns back to the low level L, the third node signal Q3[*n*] may change to the high level H by the third node control part 322 and the fourth node signal Q4[*n*] may change to the low level L by the fourth node control part 324. Here, the first and fifth switches M1 and M5 may be turned on so that the third node signal Q3[*n*] may change to the high level H and the fourth node signal Q4[*n*] may change to the low level L.

When the input enable signal IE has the low level L and the input disable signal IEB has the high level, the first output block 340A of FIG. 3 may operate the same as the carry generate block 320 of FIGS. 5 and 6 above described.

Figure 7:
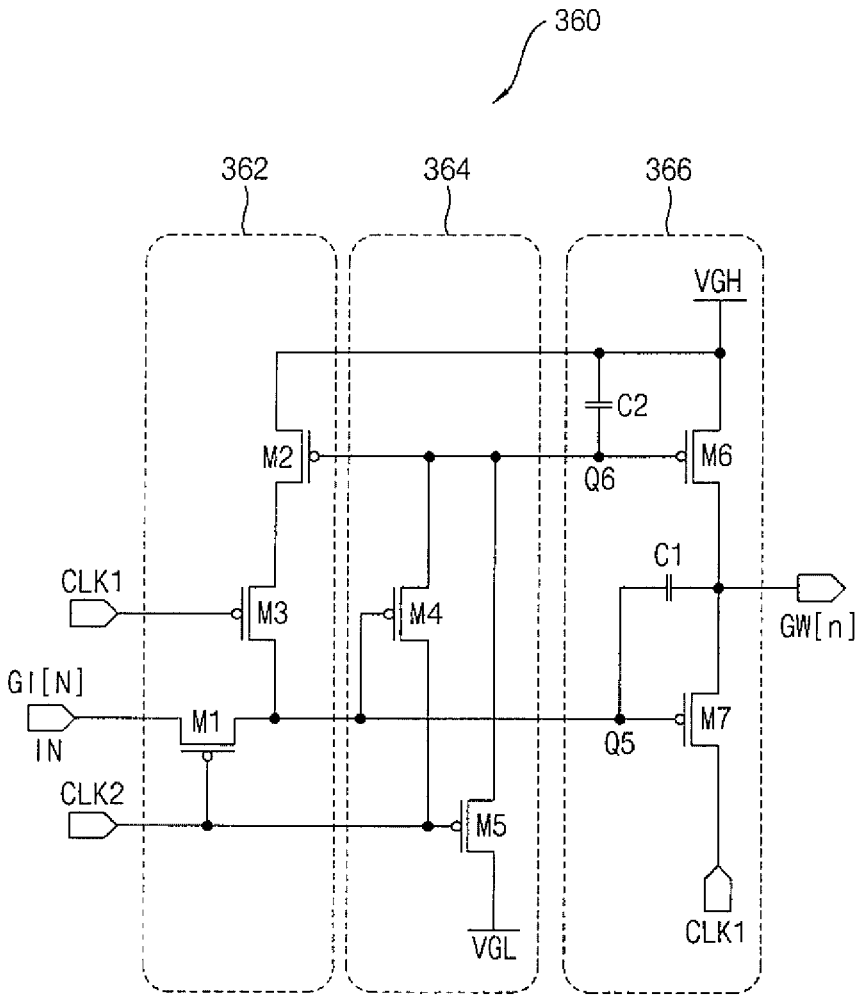
FIG. 7 is a circuit diagram illustrating an example of a second output block included in an (N)-th stage of the gate driver of FIG. 2.

FIG. 7 is a circuit diagram illustrating an example of a second output block included in an (N)-th stage of the gate driver of FIG. 2.

The second output block of the present example embodiments are substantially the same as the carry generate block explained with reference to FIG. 5. Thus, the same reference numerals will be used to refer to the same or like parts as those described in the example embodiments of FIGS. 1 to 6, and some repetitive explanation concerning the above elements will be omitted.

Referring to FIG. 7, the second output block 360 included in the (N)-th stage may include a fifth node control part 362, a sixth node control part 364, and a third output buffer part (or third output buffer) 366.

The first clock signal CLK1 may be applied to first clock terminals of the second output block 360 and the second clock signal CLK2 may be applied to second clock terminals of the second output block 360. Thus, an (N)-th gate signal GW[n] may be output delayed from an (N)-th gate initialization signal GI[n]. A delayed period between the (N)-th gate initialization signal GI[n] and the (N)-th gate signal GW[n] may correspond to one horizontal period.

The second output block 360 may receive the (N)-th gate initialization signal GI[n] from the first output block 340A. The second output block 360 may output the (N)-th gate signal GW[n] according to the output of the (N)-th gate initialization signal GI[n].

The fifth node control part 362 may transmit the (N)-th gate initialization signal GI[n] or the first DC voltage VGH to a fifth node Q5 as a fifth node signal based on the first clock signal CLK1 and the second clock signal CLK2. The fifth node control part 362 may include first to third switches M1, M2, and, M3. The configuration and operation of the fifth node control part 362 may be substantially the same as the first node control part 342 of the first output block 340A.

The sixth node control part 364 may transmit the second DC voltage VGL or the second clock signal CLK2 to a sixth node Q6 as a sixth node signal based on the second clock signal CLK2 and the fifth node signal. The sixth node control part 364 may include fourth and fifth switches M4 and M. The configuration and operation of the sixth node control part 364 may be substantially the same as the second node control part 344 of the first output block 340A.

The third output buffer part 366 may output the (N)-th gate signal GW[n] based on the fifth node signal and the sixth node signal. The third output buffer part 366 may include a pull-up switch M6 and a pull-down switch M7. The third output buffer part 366 may further include capacitors C1 and C2 connected to respective the pull-up switch M6 and the pull-down switch M7.

Because the operations of the second output block 360 are substantially the same as the first output block 340A and the carry generate block 320, some duplicated descriptions will not be repeated.

Figure 8:
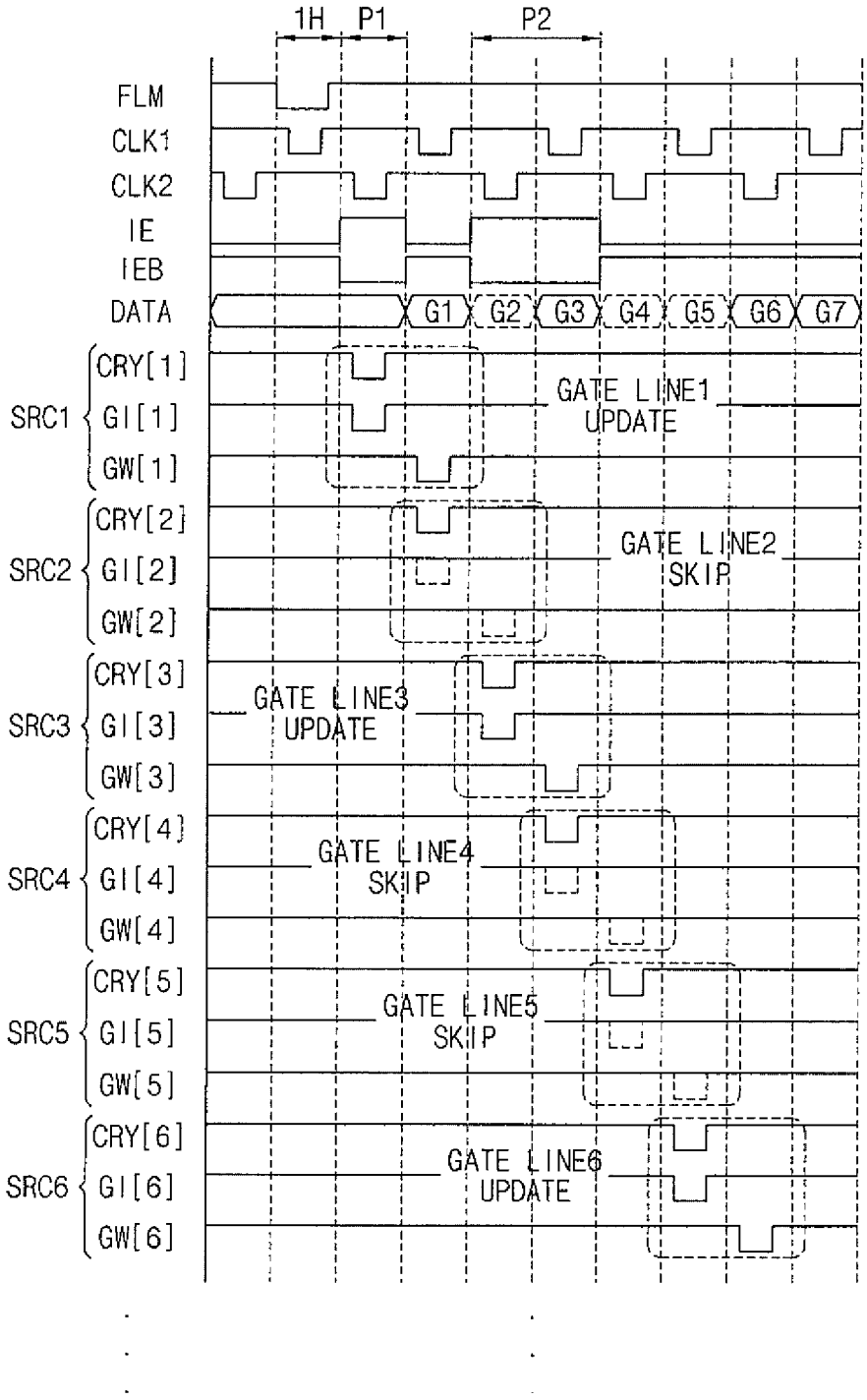
FIG. 8 is a timing diagram for explaining operations of the gate driver of FIG. 2.

FIG. 8 is a timing diagram for explaining operations of the gate driver of FIG. 2.

Referring to FIG. 8, the gate driver 300 may selectively output (or selectively skip) gate initialization signals and gate signals based on an input enable signal IE and an input disable signal IEB.

As a frame start indication signal FLM having a low level is applied to a first stage SRC1, a plurality of stages may sequentially output carry signals CRY[1], CRY[2], . . . , gate initialization signals GI[1], GI[2], . . . , and gate signals GW[1], GW[2], . . . . The frame start indication signal FLM or the carry signal of a previous stage may be concurrently applied to the carry generate block 320 and the first output block 340A of the same stage so that a present carry signal (e.g., CRY[n]) and a present gate initialization signal (e.g., GI[n]) of the same stage (e.g., SRCn) may be concurrently output. An output of the second output block 360 depends on an output of the first output block 340A so that a present gate signal (e.g., GW[n]) may be output delayed from the present carry signal (e.g., CRY[n]) and the present gate initialization signal (e.g., GI[n]). A delayed period between an (N)-th gate initialization signal GI[n] and an (N)-th gate signal GW[n] may correspond to one horizontal period.

In some embodiments, when the input signal (e.g., CRY [n−1]) having the low level is applied to the (N)-th stage during the input enable signal IE having the high level is applied to the gate driver 300, the outputs of the (N)-th gate initialization signal (e.g., GI[n]) and the (N)-th gate signal (e.g., GW[n]) may be skipped. For example, as illustrated in FIG. 8, the input enable signal IE having the high level and the input disable signal having the low level may be applied to the gate driver 300 in a first period P1 and a second period P2.

In the first period, a first carry signal CRY[1] generated in the first stage SRC1 may be applied to a second stage SRC2. Here, the first output block 340A in the second stage SRC2 may output a second gate initialization signal GI[2] having the high level. Accordingly, the second output block 360 in the second stage SRC2, which receives the second gate initialization signal GI[2], may also output a second gate signal GW[2] having the high level. Thus, the outputs of the second gate initialization signal GI[2] and the second gate signal GW[2] may be skipped.

In the second period P2, a third carry signal CRY[3] generated in a third stage SRC3 may be applied to a fourth stage SRC4 and then a fourth carry signal CRY[4] generated in the fourth stage based on the third carry signal CRY[3] may be applied to a fifth stage SRC5. The outputs of fourth and fifth gate initialization signals GI[4] and GI[5] and fourth and fifth gate signals GW[4] and GW[5] may be skipped by the high level input enable signal IE and the low level input disable signal IEB.

An operation of the carry generate block 320 is not affected by the input enable signal IE (and the input disable signal IEB) such that the carry signals CRY[1], CRY[2], . . . may be sequentially output. Thus, in the whole periods in one frame expect for the first and second periods P1 and P2, the gate initialization signals and the gate signals may be sequentially output in response to the carry signal of the previous stage.

As described above, the gate driver 300 may include the carry generate block 320 for independently generating the carry signal, the first output block 340A for selectively outputting (or skipping) the gate initialization signal GI based on the input enable signal IE and the input disable signal IEB, and the second output block 360 for selectively outputting the gate signal GW depending on the output of the gate initialization signal GI. Thus, specific gate initialization signals and gate signals in one frame may be selectively skipped (or updated). That is, the gate driver 300 may skip providing gate signals to specific gate lines (and gate initialization lines) corresponding to pixel rows required not to update image. Accordingly, it may be relatively easy to perform a partial driving and a partial displaying of the display panel, and an output swing frequency of the data driver according to an image change (or image update) may be reduced, and thus power consumption of the display device 1000 may be reduced.

Figure 9:
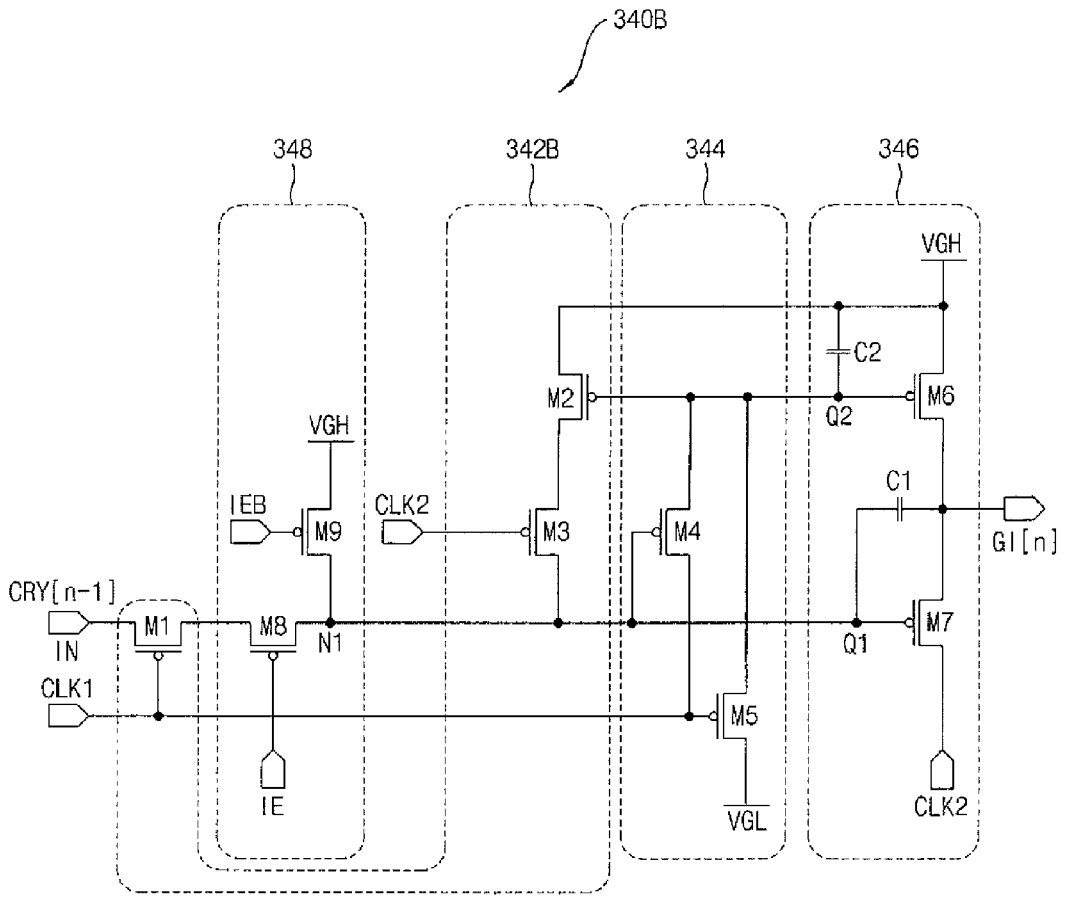
FIG. 9 is a circuit diagram illustrating another example of a first output block included in an (N)-th stage of the gate driver of FIG. 2.

FIG. 9 is a circuit diagram illustrating another example of a first output block included in an (N)-th stage of the gate driver of FIG. 2.

The first output block of the present example embodiments are substantially the same as the first output block explained with reference to FIG. 3 except for constructions of the first node control part and the input control part. Thus, the same reference numerals will be used to refer to the same or like parts as those described in the example embodiments of FIGS. 1 to 6, and any repetitive explanation concerning the above elements will be omitted.

Referring to FIGS. 3, 4, and 9, the first output block 340B of an (N)-th stage may include a first node control part 342B, a second node control part 344, a first output buffer part 346, and an input control part 348.

The first node control part 342B may transmit an input node signal (e.g., FLM or CRY[n−1]), which is a signal at an input node N1, or a first direct current (DC) voltage VGH to a first node Q1 as a first node signal Q1[*n*] based on a first clock signal CLK1 and a second clock signal CLK2. The first node control part 342 may include a first switch M1, a second switch M2, and a third switch M3.

The first switch M1 may include a gate electrode to which the first clock signal CLK1 is applied, a source connected to an input terminal IN to which the input signal CRY[n−1] is applied, and a drain electrode connected to a source electrode of a first control switch M8. The second switch M2 may include a gate electrode to which a second node signal, which is a signal at a the second node Q2, is applied, a source electrode to which the first DC voltage VGH is applied, and a drain electrode configured to provide the first DC voltage VGH to the first node Q1. The third switch M3 may include a gate electrode to which the second clock signal CLK2 is applied, a source electrode connected to the drain electrode of the second switch M2, and a drain electrode connected to the first node Q1. Here, the second and third switches M2 and M3 may be connected in series each other.

Because constructions of the second node control part 344, the first output buffer part 346, and the input control part 348 are substantially the same as the first output block 340A of FIG. 3, duplicated descriptions will not be repeated.

Accordingly, only the first control switch M8 is exist in a path that the first DC voltage VGH is applied from the input control part 348 to the first node Q1 so that the output stability of the first output block 340B may be improved.

Figure 10:
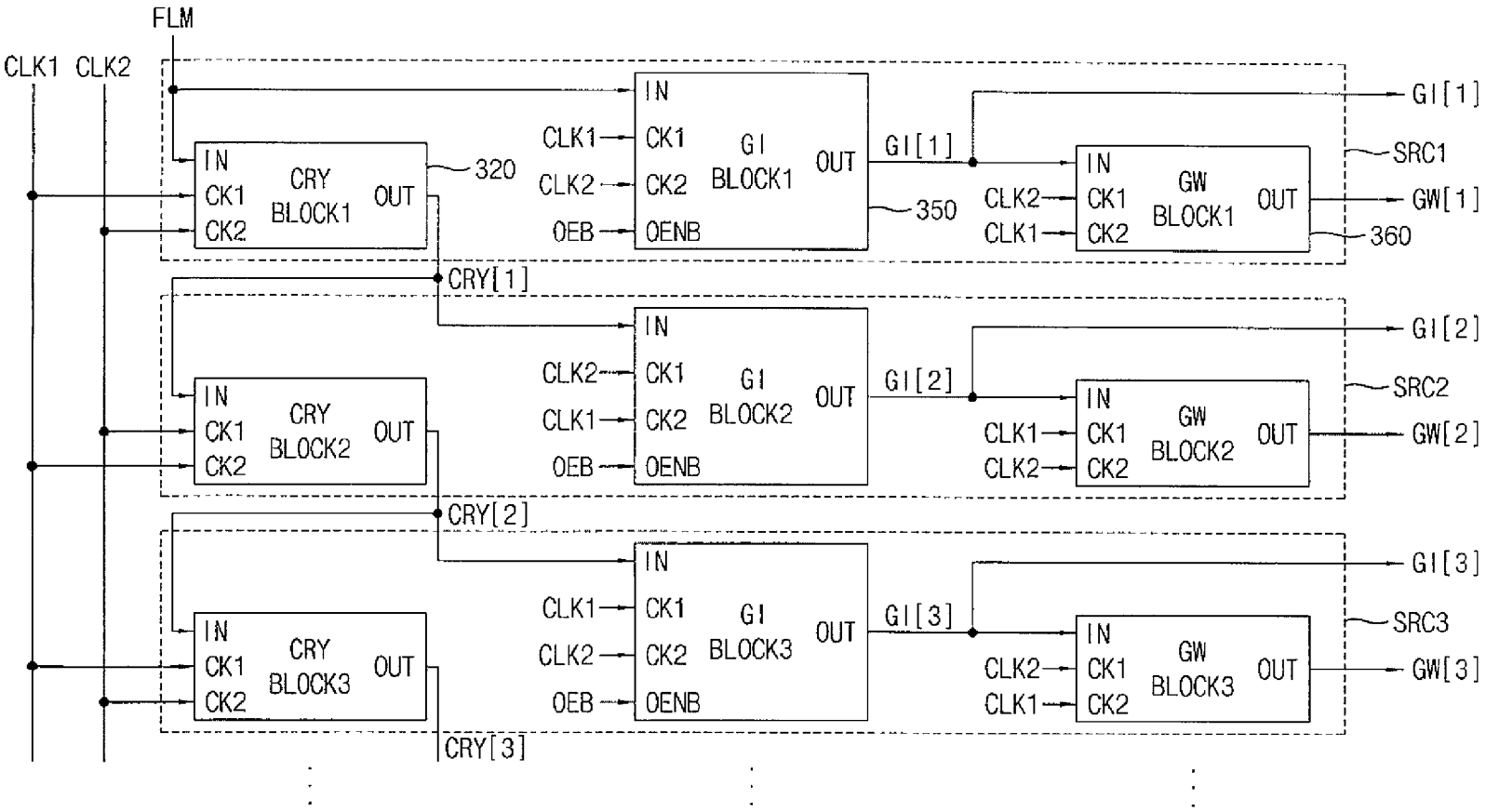
FIG. 10 is a block diagram of a gate driver according to some example embodiments of the present invention.

FIG. 10 is a block diagram of a gate driver according to example embodiments.

The gate driver of the present example embodiments are substantially the same as the gate driver explained with reference to FIG. 2 except for an output disable signal applied to a first output block. Thus, the same reference numerals will be used to refer to the same or like parts as those described in the example embodiments of FIGS. 1 and 2, and some repetitive explanation concerning the above elements will be omitted.

Referring to FIG. 10, the gate driver may include a plurality of stages SRC1, SRC2, SRC3, . . . connected to one another.

Each of the stages SRC1, SRC2, SRC3, . . . may include a carry generate block 320, a first output block 350, and a second output block 360. Each of the carry output blocks 320, the first output block 350, and the second output block 360 may include an input terminal IN, a first clock terminal CK1, a second clock terminal CK2, and an output terminal OUT. The first output block 340 may further include a disable terminal OENB receiving an output disable signal. The carry generate block 320, the first output block 340, and the second output block 360 may further include terminals each receive a first direct current (DC) voltage and a second DC voltage less than the first DC voltage. In some embodiments, the first output block 350 may further include an enable terminal receiving an output enable signal. The output enable signal may be a signal inverted from the output disable signal.

The carry generate block 320 may output the carry signal CRY[1] based on the input signal FLM.

The first output block 350 may output the gate initialization signal GI[1] based on the input signal FLM and the output disable signal OEB. In some embodiments, the first output block 350 may further receive the output enable signal. The output disable signal OEB may be applied to the all stages SRC1, SRC2, SRC3, . . . in common. The frame start indication signal FLM or the carry signal of the previous stage may be applied to the input terminal IN of the first output block 340. That is, the frame start indication signal FLM may be applied to the input terminal IN of the first output block 340 of the first stage SRC1, and the carry signals of the previous stages may be applied to the respective input terminals IN of the other first output blocks of the stages SRC2, SRC3, . . . . The output terminal OUT of the first output block 350 may transmit the gate initialization signal GI[1] to the second output block 360 of the same stage and the corresponding gate initialization line. Here, the first output block 350 may not output the gate initialization signal when the output disable signal OEB has a low level.

The second output block 360 may receive the gate initialization signal GI[1] and output the gate signal GW[1] according to the gate initialization signal GI[1]. The gate signal GW[1] may be delayed one horizontal period form the gate initialization signal GI[1]. The second output block 360 may output the gate signal GW[1] depending on the output of the gate initialization signal GI[1], so that the second output block 360 may cannot output the gate signal GW[1] without the output of the gate initialization signal GI[1].

Figure 11:
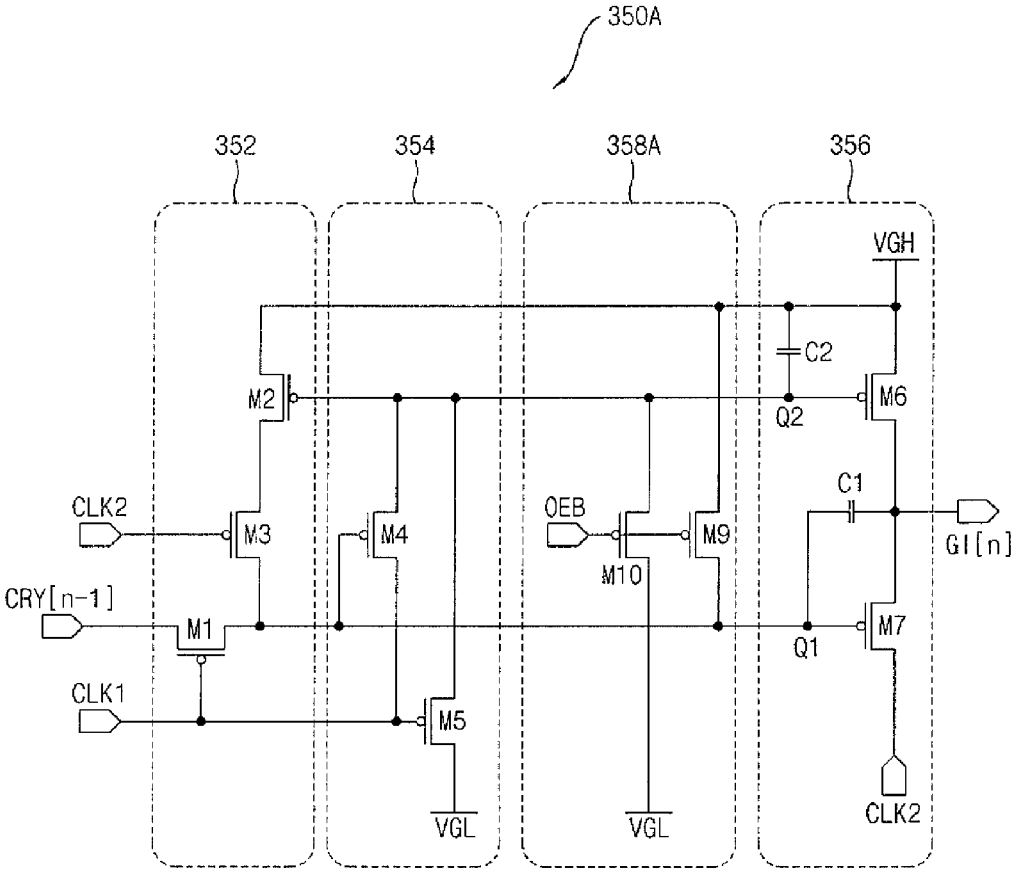
FIG. 11 is a circuit diagram illustrating an example of a first output block included in an (N)-th stage of the gate driver of FIG. 10.
Figure 12:
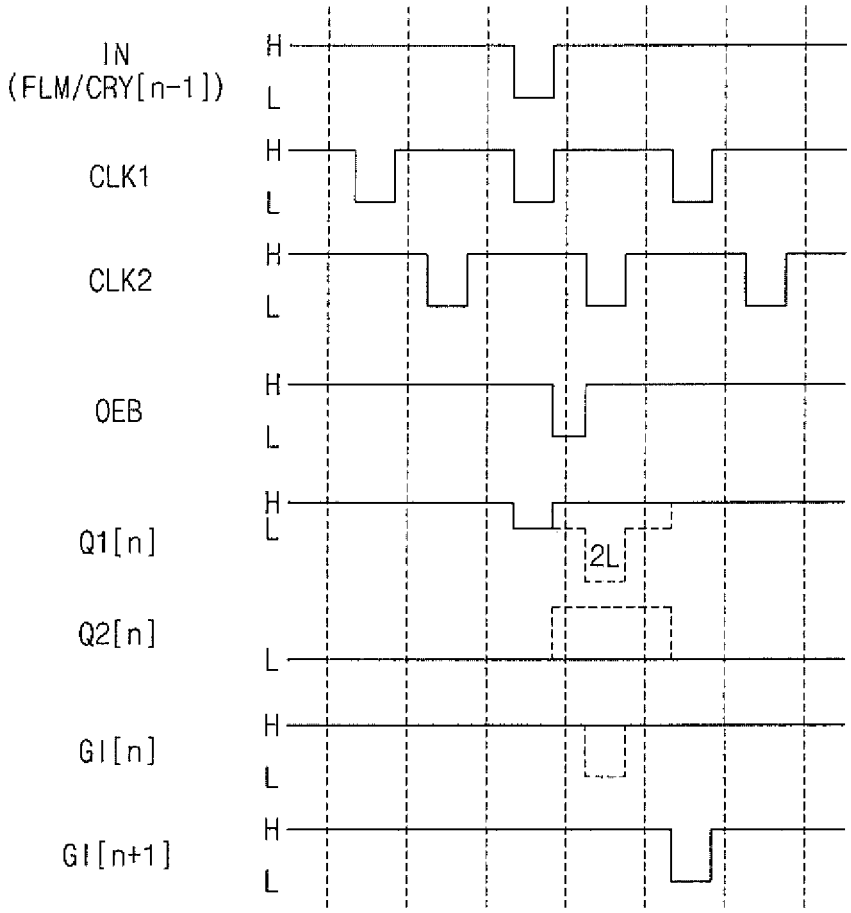
FIG. 12 is a timing diagram for explaining operations of the first output block of FIG. 11.

FIG. 11 is a circuit diagram illustrating an example of a first output block included in an (N)-th stage of the gate driver of FIG. 10. FIG. 12 is a timing diagram for explaining operations of the first output block of FIG. 11.

The first output block of the present example embodiments are substantially the same as the first output block explained with reference to FIG. 3 except for the configuration of an output control part. Thus, the same reference numerals will be used to refer to the same or like parts as those described in the example embodiments of FIGS. 1 to 6, and any repetitive explanation concerning the above elements will be omitted.

Referring to FIGS. 11 and 12, the first output block 350A of the (N)-th stage may include a first node control part 352, a second node control part 354, an output buffer part 356, and an output control part 358.

The first node control part 352 may transmit an input node signal (e.g., FLM or CRY[n−1]), which is a signal at an input node N1, or a first direct current (DC) voltage VGH to a first node Q1 as a first node signal Q1[*n*] based on a first clock signal CLK1 and a second clock signal CLK2. The first node control part 342 may include a first switch M1, a second switch M2, and a third switch M3.

The second node control part 354 may transmit a second DC voltage VGL less than the first DC voltage VGH or the first clock signal CLK1 to the second node Q2 as a second node signal Q2[*n*] based on the first node signal Q1[*n*]. The second node control part 354 may include a fourth switch M4 and a fifth switch M5.

The output buffer part 356 may output the (N)-th gate initialization signal GI[n] based on the first node signal Q1[*n*] and the second node signal Q2[*n*]. The first output buffer part 346 may include a pull-up switch M6 and a pull-down switch M7.

The output control part 358A may initialize the first node signal Q1[*n*] and the second node signal Q2[*n*] based on the output disable signal OEB. In some embodiments, when the output disable signal OEB has a low level L, the output control part 358A may apply the first DC voltage VGH to the first node Q1 and apply the second DC voltage VGL to the second node Q2. The initializing the first and second node signals Q1[*n*] and Q2[*n*] may mean that the first DC voltage VGH and the second DC voltage CGL are applied to the first node Q1 and the second node Q2, respectively. Thus, the (N)-th gate initialization signal GI[n] output from the output terminal may maintain the high level H. In some embodiments, the output control part 358A may include a first control switch M9 and a second control switch M10.

The first control switch M9 may include a gate electrode to which the output disable signal OEB is applied, a source electrode to which the first DC voltage VGH is applied, and a drain electrode connected to the first node Q1. The second control switch M10 may include a gate electrode to which the output disable signal OEB is applied, a source electrode to which the second DC voltage VGL is applied, and a drain electrode connected to the second node Q2. When the output disable signal OEB has the low level L, the first and second control switches M9 and M10 may be turned on so that the first node signal Q1[*n*] may have the high level by the first DC voltage VGH and the second node signal Q2[*n*] may have the low level by the second DC voltage VGL.

When the output disable signal OEB has the high level H, the first and second control switches M9 and M10 may be turned off so that the first output block 350A may operate substantially the same as the carry generate block 320.

Hereinafter, operations of the first output block 350A of the (N)-th stage when the output disable signal OEB has the low level L will be explained with reference to FIGS. 11 and 12.

In some embodiments, the first output blocks included in the respective stages may sequentially output the gate initialization signals. The first output block 340A may skip the output of the gate initialization signal GI[n] based on the output disable signal OEB.

When the input signal CRY[n−1] and the first clock signal CLK1 have the low level L, the first node signal Q1[*n*] may have the low level L by the first node control part 352. Here, the second node signal Q[2] may maintain the low level L by the second node control part 354.

Then, when the first clock signal CLK1 and the input signal CRY[n−1] turns back to the high level H and the output disable signal OEB becomes the low level L, the first node signal Q1[*n*] may change to the high level H and the second node signal Q2[*n*] may maintain the low level L.

Then, although the second clock signal CLK2 becomes the low level L, the (N)-th gate initialization signal GI[n] may maintain the high level H. Thus, the first output block 350A of the (N)th stage may skip the output of the gate initialization signal GI[n] regardless of the input the input signal CRY[n−1].

However, in a next stage (e.g., a (N+1)-th stage), the output disable signal OEB has the high level H when the input signal (e.g., CRY[n]) having the low level is input. Thus, the (N+1)-th gate initialization signal GI[n+1] may be normally output. In this, the first output block 350A may be driven by substantially the same operation of the carry generate block (and the second output block). In addition, the first output block of the (N+1)-th stage may output the gate initialization signal GI[n+1] at the same timing as the carry signal CRY[n+1].

Figure 13:
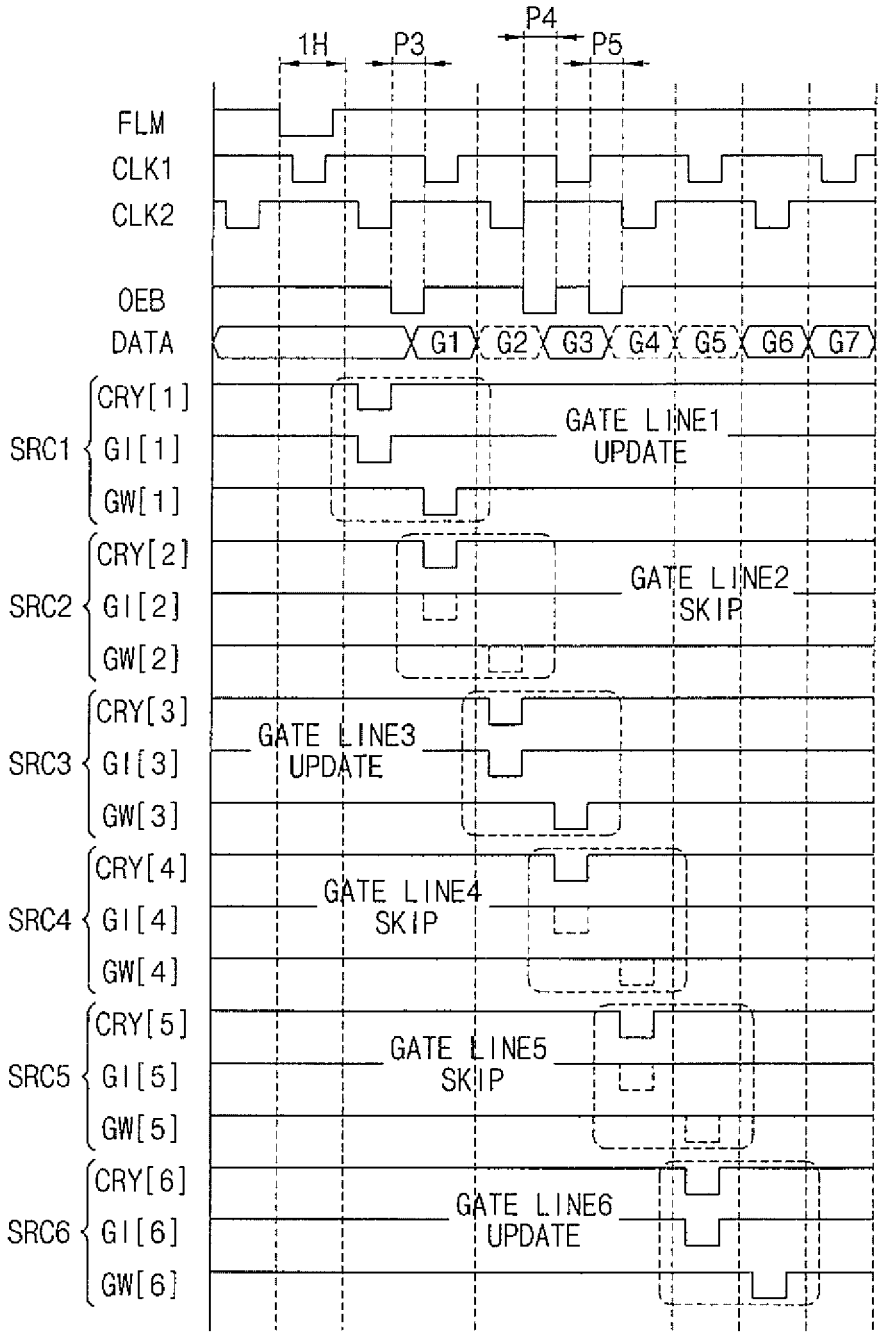
FIG. 13 is a timing diagram for explaining operations of the gate driver of FIG. 10 including the first output block of FIG. 11.

FIG. 13 is a timing diagram for explaining operations of the gate driver of FIG. 10 including the first output block of FIG. 11.

The operation of the gate driver of the present example embodiments are substantially the same as the gate driver explained with reference to FIG. 8 except for an output disable signal applied. Thus, duplicated descriptions will not be repeated.

Referring to FIGS. 10 to 13, the gate driver may selectively output (or selectively skip) gate initialization signals and gate signals based on an output disable signal OEB.

In some embodiments, when the output disable signal OEB having the low level, the first clock signal CLK1 having the high level, and the second clock signal CLK2 having the high level are applied to an (N)-th stage, the (N)-th stage may skip the outputs of the (N)-th gate initialization signal and the (N)-th gate signal. For example, as illustrated in FIG. 13, the low level output disable signal OEB may be applied to the gate driver in a first period P1, a second period P2, and a third period P3.

Because the operations of the skipping outputs of the gate initialization signal and gate signal are described above with reference to FIGS. 8 to 12, some duplicated descriptions will not be repeated.

The outputs of a second gate initialization signal GI[2] and second gate signal GW[2] may be skipped by the low level output disable signal OEB. Similarly, the outputs of fourth and fifth gate initialization signals GI[4] and GI[5] and fourth and fifth gate signals GW[4] and GW[5] may be skipped by the low level output disable signal OEB.

An operation of the carry generate block 320 is not affected by the output disable signal OEB such that the carry signals CRY[1], CRY[2], . . . may be sequentially output. Thus, in the whole periods in one frame expect for the first to third periods P3, P4, and P5, the gate initialization signals and the gate signals may be sequentially output in response to the carry signal of the previous stage.

As described above, the gate driver may include the carry generate block 320 for independently generating the carry signal, the first output block 340A for selectively outputting (or skipping) the gate initialization signal GI based on the output disable signal OEB, and the second output block 360 for selectively outputting the gate signal GW depending on the output of the gate initialization signal GI. Thus, specific gate initialization signals and gate signals in one frame may be selectively skipped (or updated). That is, the gate driver may skip providing gate signals to specific gate lines (and gate initialization lines) corresponding to pixel rows required not to update image. Thus, it is possible to line-by-line control to the gate signals (and the gate initialization signals).

In addition, it is easy to perform a partial driving and a partial displaying of the display panel, and an output swing frequency of the data driver according to an image change (or image update) may be reduced, and thus power consumption of the display device 1000 may be reduced.

Figure 14:
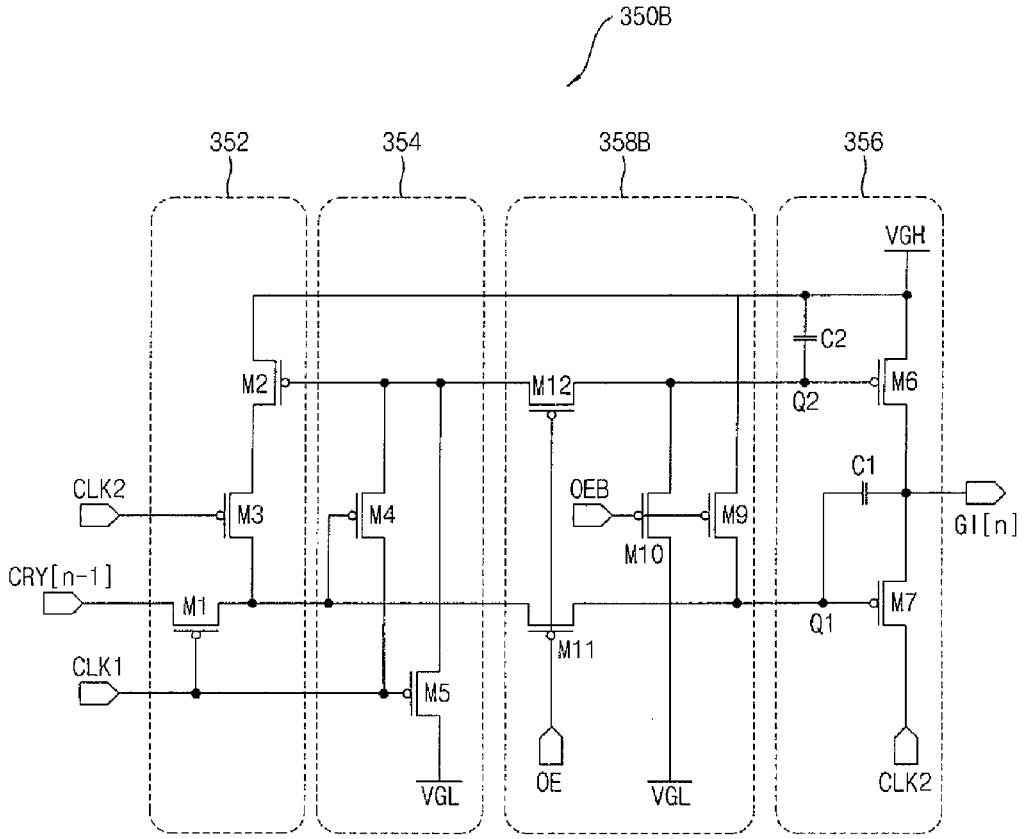
FIG. 14 is a circuit diagram illustrating another example of a first output block included in an (N)-th stage of the gate driver of FIG. 10.
Figure 15:
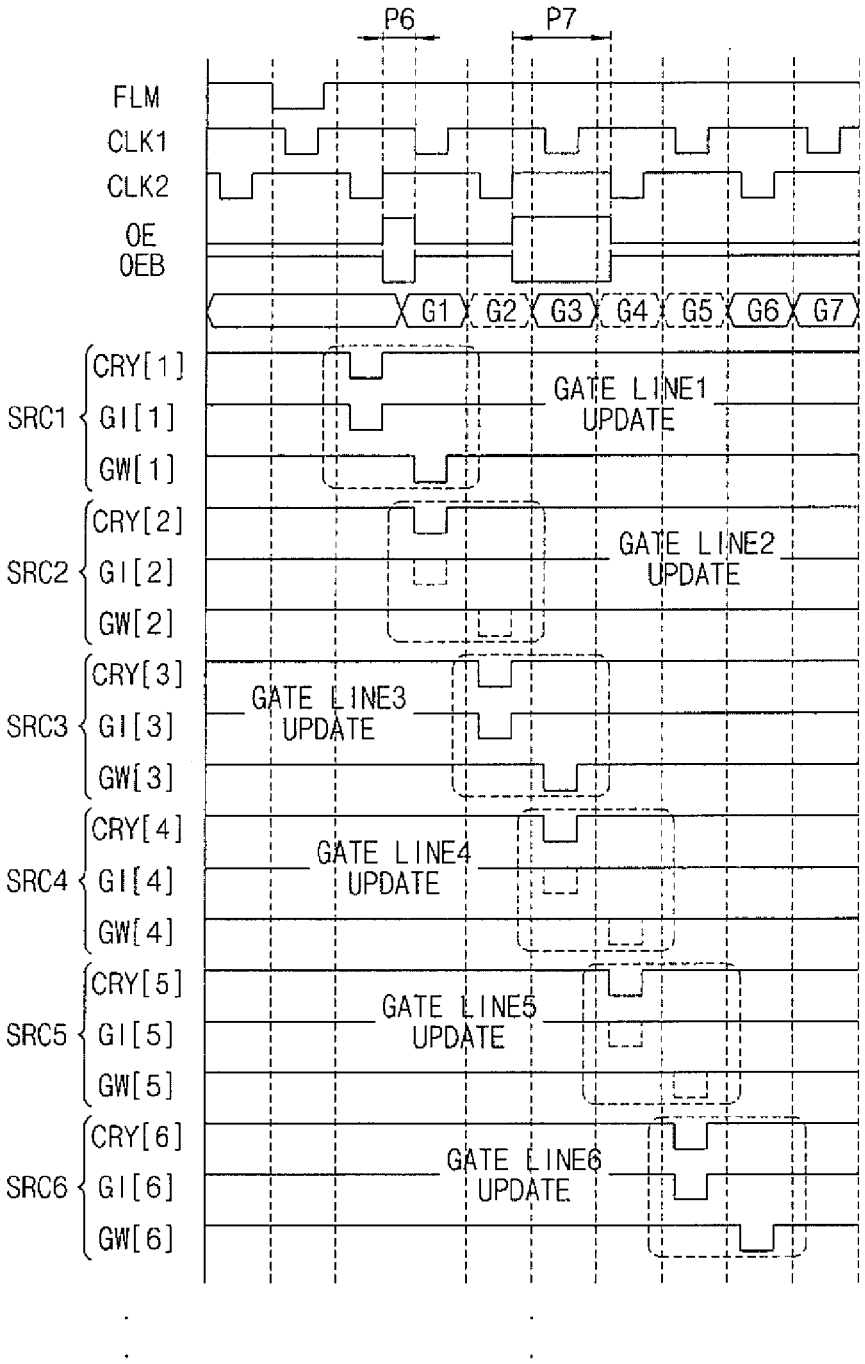
FIG. 15 is a timing diagram illustrating for explaining operations of the gate driver of FIG. 10 including the first output block of FIG. 14.

FIG. 14 is a circuit diagram illustrating another example of a first output block included in an (N)-th stage of the gate driver of FIG. 10. FIG. 15 is a timing diagram illustrating for explaining operations of the gate driver of FIG. 10 including the first output block of FIG. 14.

The first output block of the present example embodiments are substantially the same as the first output block explained with reference to FIG. 11 except for constructions of the output control part. Thus, the same reference numerals will be used to refer to the same or like parts as those described in the example embodiments of FIGS. 11 to 13, and some repetitive explanation concerning the above elements will be omitted.

Referring to FIGS. 14 and 15, the first output block 350B of the (N)-th stage may include a first node control part 352, a second node control part 354, an output buffer part 356, and an output control part 358B.

The output control part 358B may initialize the first node signal Q1[*n*] and the second node signal Q2[*n*] based on an output disable signal OEB and an output enable signal OE. The output enable signal OE may be a signal inverted from the output disable signal OEB.

In some embodiments, when the output disable signal OEB has a low level L, the output control part 358B may apply the first DC voltage VGH to the first node Q1 and apply the second DC voltage VGL to the second node Q2. Thus, the (N)-th gate initialization signal GI[n] output from the output terminal may maintain the high level H. In some embodiments, the output control part 358B may further include a third control switch M11 and a fourth control switch M12.

The third control switch M11 may disconnect the first node control part 352 from the first node Q1 based on the output enable signal OE. The fourth control switch M12 may disconnect the second node control part 354 from the second node Q2 based on the output enable signal OE.

When the output enable signal OE has the low level, the third and fourth control switches may be turned on so that the first node control part 352 may be connected to the first node Q1 and the second node control part 354 may be connected to the second node Q2. In contrast, when the output enable signal OE has the high level, the third and fourth control switches may be turned off so that the gate initialization signal cannot be output.

As illustrated in FIG. 15, the high level output disable signal OEB and the low level output enable signal OE are applied to the gate driver in a period P7 to skip continuous gate signals and gate initialization signals (e.g., to skip outputs of fourth and fifth gate initialization signals GI[4] and GI[5] and fourth and fifth gate signals GW[4] and GW[5]).

Because the driving timing of the gate driver of FIG. 15 is substantially the same as the operation of FIG. 13 except for transitions of the output enable signal OE and the output disable signal OEB, some duplicated descriptions will not be repeated.

As described above, the gate driver may include the carry generate block for independently generating the carry signal, the first output block for selectively outputting (or skipping) the gate initialization signal GI based on the input disable signal IEB or the output disable signal OEB, and the second output block for selectively outputting the gate signal GW depending on the output of the gate initialization signal GI. Thus, specific gate initialization signals and gate signals in one frame may be selectively skipped (or updated). That is, the gate driver may skip providing gate signals to specific gate lines (and gate initialization lines) corresponding to pixel rows required not to update image. Thus, it is possible to line-by-line control to the gate signals (and the gate initialization signals).

In addition, it may be relatively easy to perform a partial driving and a partial displaying of the display panel, and an output swing frequency of the data driver according to an image change (or image update) may be reduced, and thus power consumption of the display device may be reduced.

The present embodiments may be applied to any gate drivers driving a plurality of gate lines and any display device including the gate driver. For example, the present embodiments may be applied to an organic light emitting display device, a liquid crystal display device, etc., and may be further applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and aspects of example embodiments.

Accordingly, all such modifications are intended to be included within the scope of example embodiments as defined in the claims, and their equivalents. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims, and their equivalents. The inventive concept is defined by the following claims, with equivalents of the claims to be included therein.

What is claimed is:

1. A gate driver comprising a plurality of stages configured to respectively output a plurality of gate signals and a plurality of gate initialization signals, an (N)-th stage from among the plurality of stages comprising:

a carry generate block configured to output an (N)-th carry signal based on an input signal and to provide the (N)-th carry signal to an (N+1)-th stage;

a first output block configured to output an (N)-th gate initialization signal based on the input signal, an input enable signal, and an input disable signal, wherein the input disable signal is inverted with respect to the input enable signal; and a second output block configured to receive the (N)-th gate initialization signal and to output an (N)-th gate signal according to the output of the (N)-th gate initialization signal, the (N)-th gate signal being delayed one horizontal period from the (N)-th gate initialization signal, wherein the gate signals and the gate initialization signals of the stages are selectively output based on the input enable signal and the input disable signal, and wherein N is a positive integer.

2. The gate driver of claim 1, wherein the first output block comprises:

a first node controller configured to transmit an input node signal, which is a signal at an input node, or a first direct current (DC) voltage to a first node as a first node signal based on a first clock signal and a second clock signal;

a second node controller configured to transmit a second DC voltage less than the first DC voltage or the first clock signal to a second node as a second node signal based on the first node signal;

a first output buffer configured to output the (N)-th gate initialization signal based on the first node signal and the second node signal; and an input controller configured to control the input node signal based on the input enable signal and the input disable signal.

3. The gate driver of claim 2, wherein the input signal is provided to the input node as the input node signal when the input enable signal has a low level, and the first DC voltage is provided to the input node as the input node signal when the input enable signal has a high level.

4. The gate driver of claim 2, wherein the input controller comprises:

a first control switch comprising a gate electrode to which the input enable signal is applied, a source electrode to which the input signal is applied, and a drain electrode connected to the input node; and a second control switch comprising a gate electrode to which the input disable signal is applied, a source electrode to which the first DC voltage is applied, and a drain electrode connected to the input node.

5. The gate driver of claim 4, wherein the first node controller comprises:

a first switch comprising a gate electrode configured to receive the first clock signal, a source connected to the input node, and a drain electrode connected to the first node;

a second switch comprising a gate electrode configured to receive the second node signal, a source electrode to which the first DC signal is applied, and a drain electrode configured to provide the first DC voltage to the first node; and a third switch comprising a gate electrode configured to receive the second clock signal, a source electrode connected to the drain electrode of the second switch, and a drain electrode connected to the first node.

6. The gate driver of claim 4, wherein the first node controller comprises:

a first switch comprising a gate electrode configured to receive the first clock signal, a source electrode connected to an input terminal configured to receive the input signal, and a drain electrode connected to the source electrode of the first control switch;

a second switch comprising a gate electrode configured to receive the second node signal, a source electrode configured to receive the first DC signal, and a drain electrode configured to provide the first DC voltage to the first node; and a third switch comprising a gate electrode configured to receive the second clock signal, a source electrode connected to the drain electrode of the second switch, and a drain electrode connected to the first node.

7. The gate driver of claim 4, wherein the second node controller comprises:

a fourth switch comprising a gate electrode configured to receive the first node signal, a source electrode configured to receive the first clock signal, and a drain electrode connected to the second node; and a fifth switch comprising a gate electrode configured to receive the first clock signal, a source electrode configured to receive the second DC voltage, and a drain electrode connected to the second node.

8. The gate driver of claim 4, wherein the first output buffer comprises:

a pull-up switch comprising a gate electrode connected to the second node, a source electrode configured to receive a pull-up voltage, and a drain electrode connected to an output terminal configured to output the (N)-th gate initialization signal; and a pull-down switch comprising a gate electrode connected to the first node, a source electrode connected to the output terminal, and a drain electrode configured to receive the second clock signal.

9. The gate driver of claim 2, wherein the carry generate block comprises:

a third node controller configured to transmit the input signal or the first DC voltage to a third node as a third node signal based on the first clock signal and the second clock signal;

a fourth node controller configured to transmit the second DC voltage or the first clock signal to a fourth node as a fourth node signal based on the first clock signal and the third node signal; and a second output buffer configured to output the (N)-th carry signal based on the third node signal and the fourth node signal.

10. The gate driver of claim 9, wherein the second output block comprises:

a fifth node controller configured to transmit the (N)-th gate initialization signal or the first DC voltage to a fifth node as a fifth node signal based on the first clock signal and the second clock signal;

a sixth node controller configured to transmit the second DC voltage or the second clock signal to a sixth node as a sixth node signal based on the second clock signal and the fifth node signal; and a third output buffer configured to output the (N)-th gate signal based on the fifth node signal and the sixth node signal.

11. The gate driver of claim 1, wherein the input signal is a frame start indication signal or a carry signal of a previous stage.

12. The gate driver of claim 1, wherein the (N)-th stage is configured to skip output of the (N)-th gate initialization signal and the (N)-th gate signal when the (N)-th stage receives the input signal having a low level and the input enable signal having a high level.

13. A gate driver comprising a plurality of stages configured to respectively output a plurality of gate signals and a plurality of gate initialization signals, an (N)-th stage from among the plurality of stages comprising:

a carry generate block configured to output an (N)-th carry signal based on an input signal and to provide the (N)-th carry signal to an (N+1)-th stage;

a first output block configured to output an (N)-th gate initialization signal based on the input signal and an output disable signal; and a second output block configured to receive the (N)-th gate initialization signal and to output an (N)-th gate signal according to the output of the (N)-th gate initialization signal, the (N)-th gate signal being delayed one horizontal period from the (N)-th gate initialization signal, wherein the gate signals and the gate initialization signals of the stages are selectively output based on the output disable signal, and wherein N is a positive integer.

14. The gate driver of claim 13, wherein the first output block comprises:

a first node controller configured to transmit the input signal or a first direct current (DC) voltage to a first node as a first node signal based on a first clock signal and a second clock signal;

a second node controller configured to transmit a second DC voltage less than the first DC voltage or the first clock signal to a second node as a second node signal based on the first clock signal and the first node signal;

an output buffer configured to output the (N)-th gate initialization signal based on the first node signal and the second node signal; and an output controller configured to initialize the first node signal and the second node signal based on the output disable signal.

15. The gate driver of claim 14, wherein the output controller is configured to apply the first DC voltage to the first node and to apply the second DC voltage to the second node, when the output disable signal has a low level.

16. The gate driver of claim 14, wherein the output controller comprises:

a first control switch comprising a gate electrode configured to receive the output disable signal, a source electrode configured to receive the first DC voltage, and a drain electrode connected to the first node; and a second control switch comprising a gate electrode configured to receive the output disable signal, a source electrode configured to receive the second DC voltage, and a drain electrode connected to the second node.

17. The gate driver of claim 16, wherein the (N)-th stage is configured to skip output of the (N)-th gate initialization signal and the (N)-th gate signal when the (N)-th stage receives the first clock signal having a high level, the second clock signal having the high level, and the output disable signal having a low level.

18. The gate driver of claim 16, wherein the output controller further comprises:

a third control switch configured to disconnect the first node controller from the first node based on an output enable signal, wherein the output enable signal is inverted with respect to the output disable signal; and a fourth control switch configured to disconnect the second node controller from the second node based on the output enable signal.

19. A display device comprising:

a display panel comprising a plurality of pixels;

a data driver configured to output a plurality of data signals to the display panel via a plurality of data lines; and a gate driver comprising a plurality of stages configured to respectively output a plurality of gate signals and a plurality of gate initialization signals to the display panel, wherein an (N)-th stage of the gate driver comprises:

a carry generate block configured to output an (N)-th carry signal based on an input signal and to provide the (N)-th carry signal to an (N+1)-th stage;

a first output block configured to output an (N)-th gate initialization signal based on the input signal, an input enable signal, and an input disable signal, wherein the input disable signal is inverted with respect to the input enable signal; and a second output block configured to receive the (N)-th gate initialization signal and to output an (N)-th gate signal according to the output of the (N)-th gate initialization signal, the (N)-th gate signal being delayed one horizontal period from the (N)-th gate initialization signal, wherein the gate signals and the gate initialization signals of the stages are selectively output based on the input enable signal and the input disable signal, and wherein N is a positive integer.

20. The display device of claim 19, wherein the (N)-th stage is configured to skip output of the (N)-th gate initialization signal and the (N)-th gate signal when the (N)-th stage receives the input signal having a low level and the input enable signal having a high level.

* * * * *